United States Patent [19]

Burdett, Jr.

[11] 4,207,021

[45] Jun. 10, 1980

[54] OPENING AND EMPTYING OF BAGS FILLED WITH BULK MATERIALS

[76] Inventor: Harry W. Burdett, Jr., 9-05 Second St., Fair Lawn, N.J. 07410

[21] Appl. No.: 955,909

[22] Filed: Oct. 30, 1978

Related U.S. Application Data

[60] Division of Ser. No. 887,715, Mar. 17, 1978, Pat. No. 4,134,508, which is a continuation of Ser. No. 722,059, Sep. 1, 1976, abandoned, which is a continuation-in-part of Ser. No. 532,704, Dec. 13, 1974, abandoned.

[51] Int. Cl.[2] ..... B65G 65/04

[52] U.S. Cl. ..... 414/412

[58] Field of Search ..... 414/411, 412; 83/23, 83/409, 171; 30/116

[56] References Cited

U.S. PATENT DOCUMENTS

| | | | |
|---|---|---|---|
| 1,771,797 | 7/1930 | Lewis . | |
| 2,031,869 | 2/1936 | Trouth . | |
| 2,535,029 | 12/1950 | Atanasoff et al. . | |
| 2,623,586 | 12/1952 | Volpi . | |
| 3,017,487 | 1/1962 | Priestly . | |
| 3,022,912 | 2/1962 | Vincent | 414/412 |
| 3,467,267 | 9/1969 | van Elten . | |
| 3,664,530 | 5/1972 | Takiguchi | 414/412 |
| 3,754,489 | 8/1973 | Carver, Jr. et al. . | |
| 3,884,375 | 5/1975 | Schott, Jr. et al. . | |

FOREIGN PATENT DOCUMENTS 1315853 5/1973 United Kingdom .

*Primary Examiner*—Lawrence J. Oresky
*Attorney, Agent, or Firm*—Brooks, Haidt, Haffner & Delahunty

[57] ABSTRACT

A method and apparatus for opening, emptying and disposing of 100 lb. paper, cloth or plastic bags of asbestos or other powdered or granular products by cutting longitudinally and transversely through one large bag face and perforating one or more remaining edges to produce a "U" or "H" shaped hinged flap through which the contents are emptied. Appropriately located and sequentially actuated cutters, heated to from about 800° F. to about 1000° F., utilize heat and pressure to quickly and cleanly cut each bag on a hinged and dropable table while bag is held by arrangement of spikes which form a gripping head. Gripping head moves to discharge the empty bag from the apparatus. Air spikes on gripping head ensure complete emptying of bag contents, which flow down a discharge chute below the hinged table.

26 Claims, 59 Drawing Figures

21
22
25
110
111
112
113
116
117
118
121
122
123
124
130
131
132
134
135
136
137
138

25
133
B
19
24
117
134
123
124
23
115
114
116
113
22
111
121
122
118
110

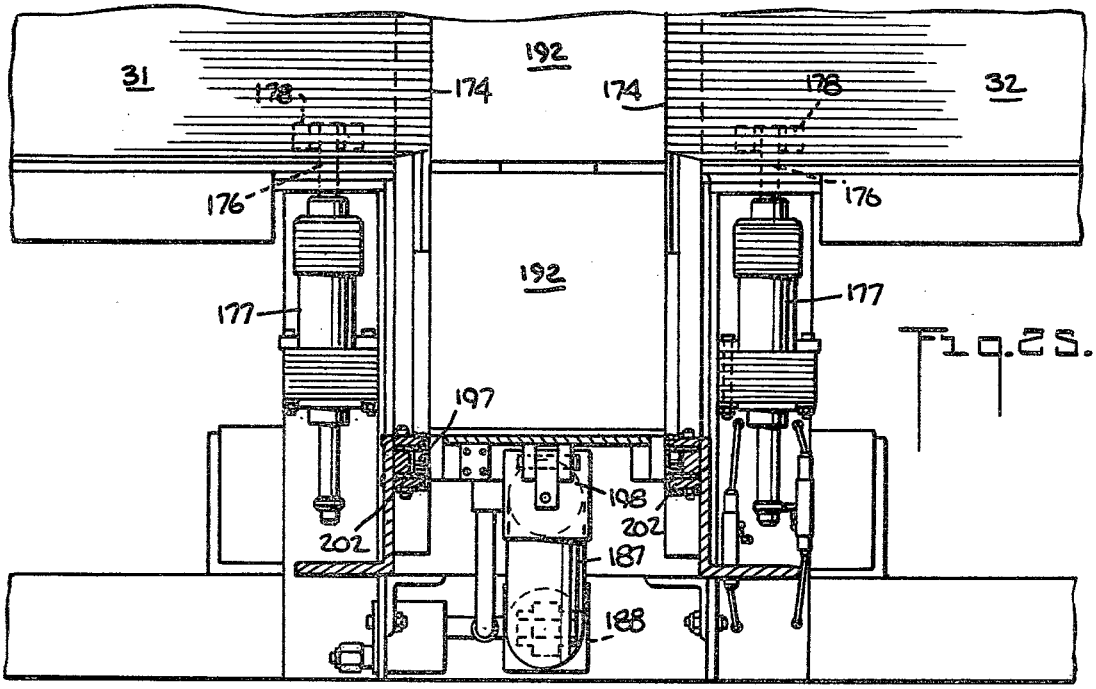
Fig. 25.
27
Fig. 24
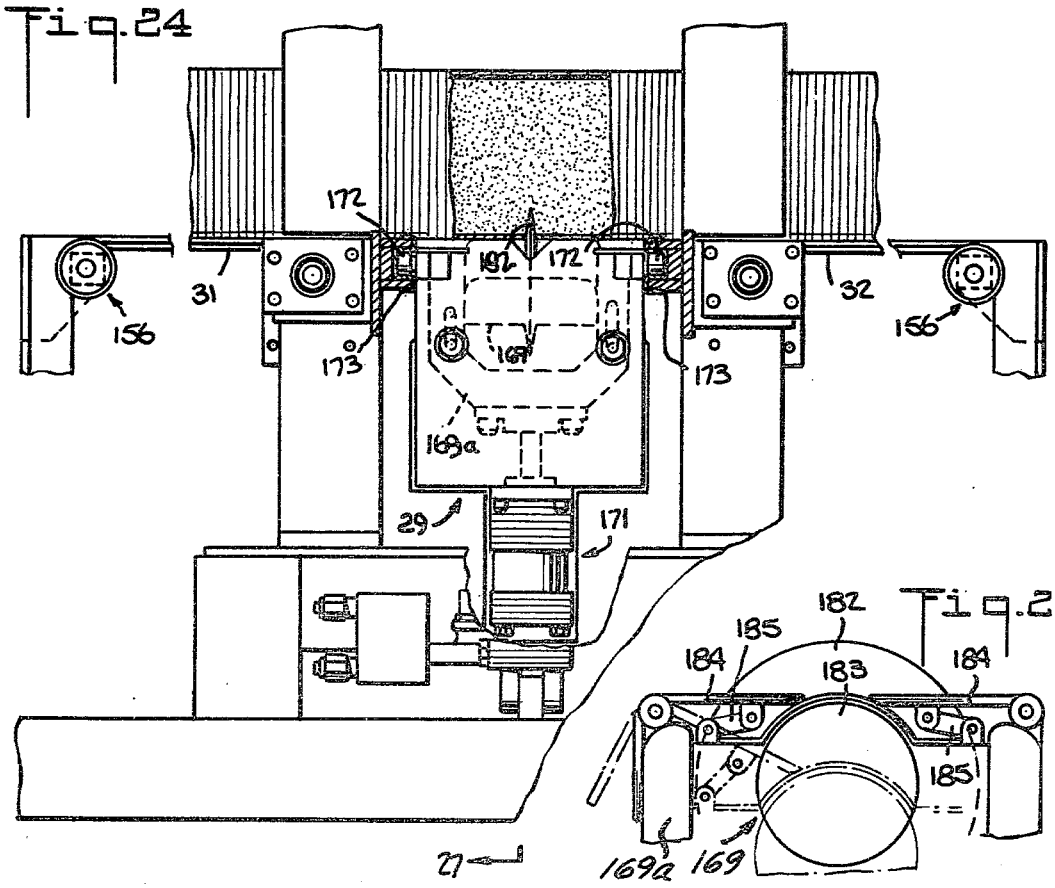
Fig. 26.

28
198
197
195
192
197
195
201
28
189
187
202
197
188

198
192
192
192
197
193
192
193
193
197

195
192
196
194

B
172
173
172
29
175
174
172
169
186

208
210
69
65
68
229
70
227
225
221
223
226
66
224
222
207
31
206
B
267
27
31

244
245
245a
247
248
45
27
251
252
253
254
255
256
257

35
B
45
245
246
246a
247
248
248a
249
250
251
252
253
254
255
257
258

260
261
263
270
267
55
272
273
271
274
275
284
276
277
278
279
285
286
287
288
289
290
B

Fig. 46.
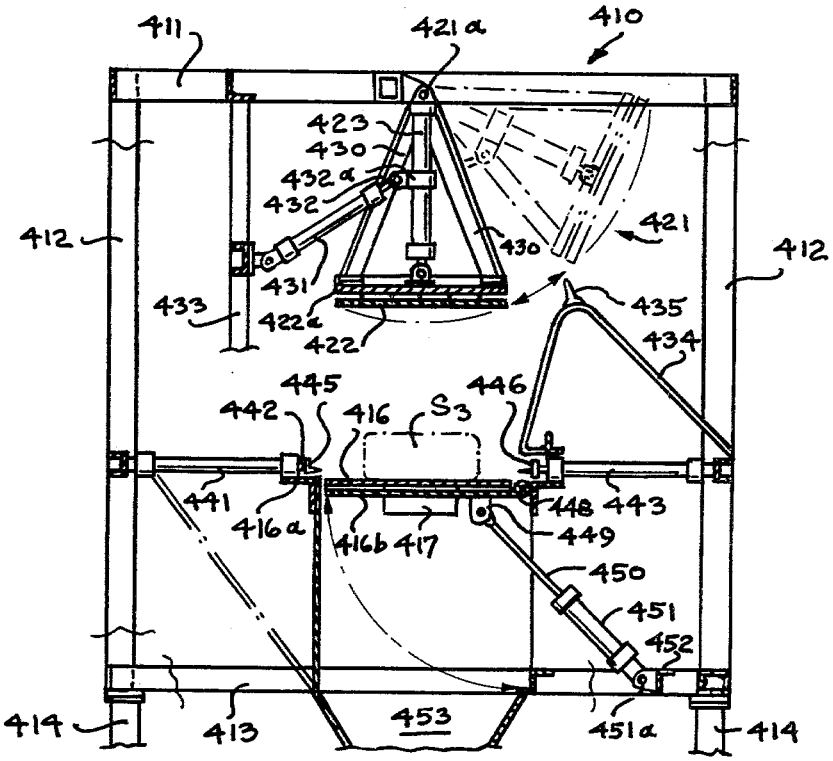
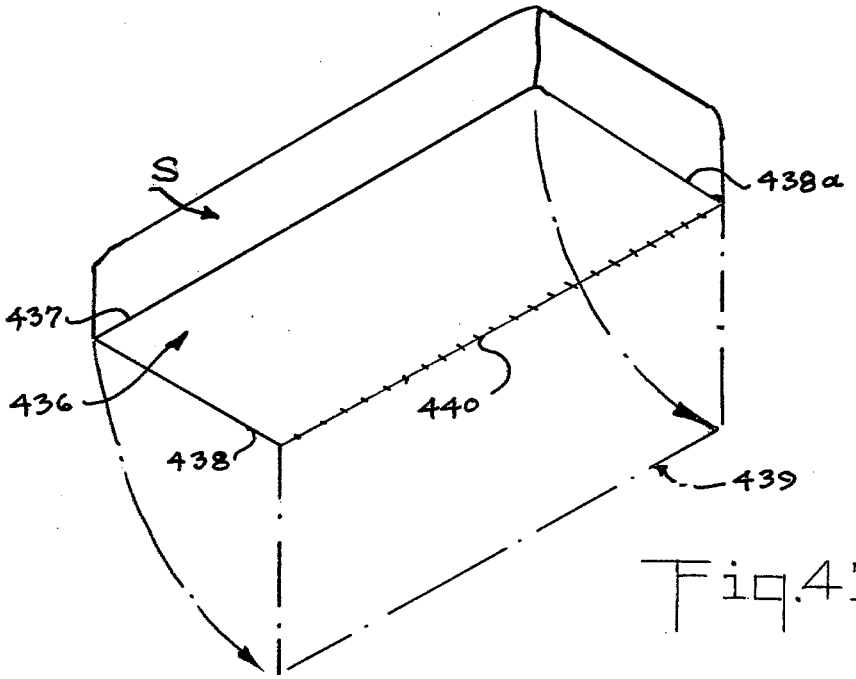
Fig. 47.

Fig. 53
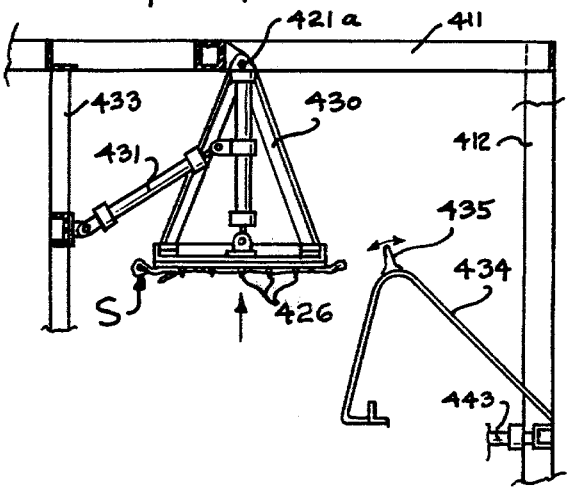
Fig. 54
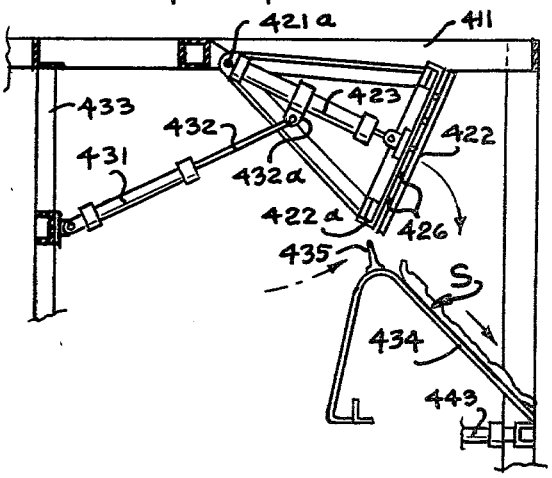
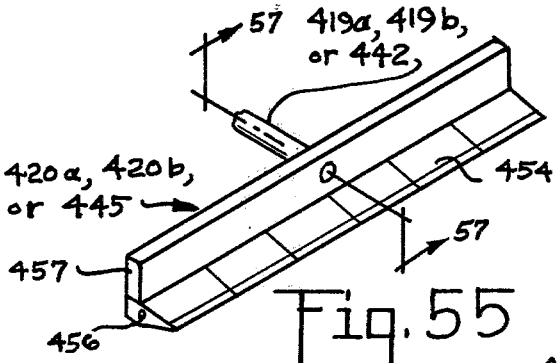
Fig. 55
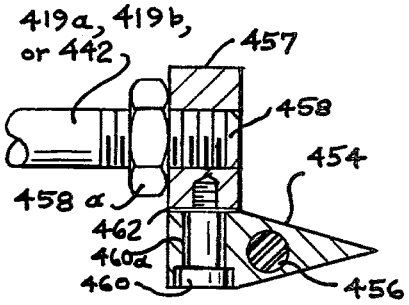
Fig. 57
Fig. 56
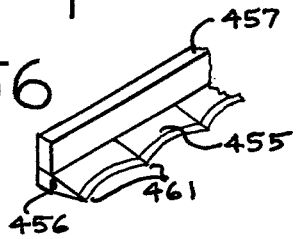
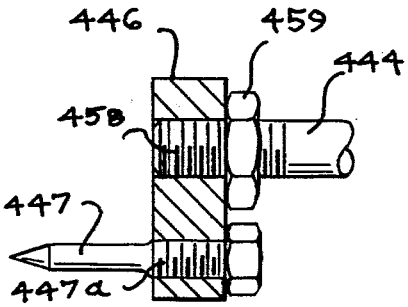
Fig. 59
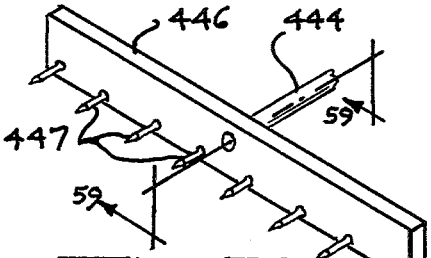
Fig. 58

OPENING AND EMPTYING OF BAGS FILLED WITH BULK MATERIALS

CROSS REFERENCE TO RELATED APPLICATIONS

This is a division of application Ser. No. 887,715, filed Mar. 17, 1978 now U.S. Pat. No. 4,134,508 issued Jan. 16, 1979, which was a continuation of application Ser. No. 722,059, filed Sept. 1, 1976, now abandoned, which was a continuation-in-part of application Ser. No. 532,704, filed Dec. 13, 1974, now abandoned.

BACKGROUND OF THE INVENTION

1. Field of the Invention

This invention relates to the opening and emptying of containers and more particularly to a method and apparatus for opening and emptying powdery or granular materials from large paper, cloth or plastic bags in which the material has been packaged, shipped or stored.

2. Description of the Prior Art

The packaging, shipment and storage of bulk materials in bags and sacks has long been a common practice and numerous methods and mechanisms for rapidly opening and emptying various kinds of bags have been proposed. In most prior art systems some kind of sharp knife has been employed to cut the bag wall.

Among the problems encountered in previous systems for opening bags rapidly for emptying their contents, hazards to the safey of machine operators have been an important concern. Workmen should, of course, be protected from being cut by rapidly moving knives, and the elimination of airborne dust and the prevention of fire are also necessary for safe working conditions. Certain materials often contained in the bags, such as asbestos, are themselves dangerous because of their toxic nature. As another example of the problems involved, a rapidly moving knife can cause sparks and fire by forcefully striking compacted particles when bags filled with cement powder are opened and emptied. Using present bag opening and emptying techniques, fine particles and paper shreds are often released into the air, causing fire and explosion hazards, as well as the danger of particle inhalation.

Prior industrial systems for opening and emptying bags have not provided efficiency and speed accompanied by optimum safety provisions.

Aside from safety considerations, bag opening and emptying mechanisms of the prior art have often been specialized for use in particular applications and have not been flexible enough for general use in the wide variety of industrial situations which require rapid emptying of bags of various sizes and shapes.

U.S. Pat. No. 3,664,530 relates to apparatus in which a bag of granular material is moved on a conveyor belt to a point at which a rotating circular cutter is moved across the front end of the bag to slit open that end. Then the bag proceeds between a pair of driven cutting wheels to slit open the sides of the bag, so that a U-shaped flap is formed. As the bag moves over the end of the conveyor belt the weight of the bag contents causes the flap to open, discharging the contents into a hopper while pinch rolls grab the upper part of the bag and push the emptied bag through an outlet. The bag end cutter is returned to its original position and the bag opening cycle is repeated.

Some prior art systems, such as that of U.S. Pat. No. 2,930,501, have employed straight, rather than rotary, knives.

In U.S. Pat. No. 3,415,147, heated means are suggested for severing textile fabric in making bags so as to separate the fabric along a line while heat sealing to prevent ravelling in the manufacture of bags. Another patent related to using a hot cutting device in making bags is U.S. Pat. No. 3,406,612, but instead of employing temperatures suitable for melting thermoplastic material as in the previously mentioned patent U.S. Pat. No. 3,406,612 suggests using a hot wire at a temperature of about 1300° F. to char paper by brief contact.

Some of the aforementioned patents refer to associated apparatus for aiding in emptying and disposal of bags after they have been opened. In U.S. Pat. No. 3,467,267 air is blown into a sack after the sack has been cut through its middle, to push or pump out the contents.

SUMMARY OF THE INVENTION

The bag opening and emptying arrangement of the present invention eliminates safety and health hazards presented by prior art machines while assuring quick and effective slitting and opening, and subsequent discharge of the bag contents in a closed, automatically controlled, yet flexible system. The system of the invention is complete in that it takes bags as they are conveyed sequentially into the apparatus, opens and empties them, provides for deposit of the emptied product into a hopper or chute, and disposes of each bag as it is emptied.

A wide variety of raw materials and products are currently stored and shipped in bags ranging in size from about 3"×14"×20" to about 12"×28"×48". Such bags may be of cloth, jute, burlap, multiwall paper, paper-plastic laminates, film plastic or woven-film laminates, or other suitably strong and flexible materials; are variously stitched or heat sealed; and may be provided with a valve or be of folded and glued construction. Machines in accordance with the invention automatically adjust to the size of the bags being handled, and the weight of material per bag does not affect operation.

Among the materials ordinarily packaged in nonporous bags are loose particulate substances such as sand, cement, asbestos, plastic powders and pellets, flour, etc., and solid caked material such as pressure packed asbestos. The system of the invention is capable of handling bags of any of these materials, typically emptying several bags per minute regardless of the weight of the bags.

Since the system is closed there is no danger of dust contamination from the emptying operation and safety devices prevent operator injury by moving parts.

The use of heated cutters to open a bag by means of a combination of heat and pressure is an important feature of the invention. Polyethylene, often used for bags, melts at about 250° F. Another popular bag material, kraft paper, has a kindling point of about 450° F., but must be exposed to such a temperature for about 4 seconds for ignition to occur. In accordance with the present invention, a straight or circular cutting edge heated to a temperature over 800° F. and preferably between 850°-900° F. is briefly pressed against a bag wall to form a cut. The pressure is provided either by the weight of the bag resting momentarily against the heated cutter, or by movement of the heated cutter into contact with the bag. Only momentary contact is required, so there is no danger of ignition of paper bag material. It has been found that a dull cutting edge heated to a temperature of 850°–900° F. and firmly pressed against a bag wall for a period of less than 1 second will cut the bag wall safely. A period of contact of a heated cutting wheel edge with a bag wall of about 0.4 seconds has been found to be effective. Thus a heated wheel of appropriate size passing along a bag at about 1 to 1.5 feet per second can be effectively employed. A similar momentary contact of a heated, dull, straight blade edge is also effective.

In accordance with one embodiment of the present invention, full bags are fed one at a time through a normally closed door down an inclined infeed conveyor to a vibrating table at the end of which the bag impacts a retractable stopgate. This impact squares and flattens the forward end of the bag to ensure alignment with, and backup for, subsequent cutting action. After impact and squaring of the bag, the stopgate will retract. On the vibrating table, the bag is squared between longitudinal squaring guides and a top plate flattens and compacts the bag and its contents. This action is aided by the vibration of the vibrating table. After squaring and flattening of the bag are completed, a long piston with a thrust plate at its forward end pushes the bag forward into a bag cutting station. As the bag travels through this cutting station it passes beneath a rotating pinch roll which, together with the longitudinal squaring guides, controls the bag shape. The pinch roll also provides backup pressure while guiding the bag against a pair of longitudinal cutters to a crosscut area. The pinch roll is preferably free rolling, but in some applications can be power driven.

The longitudinal cutters in one embodiment of the invention are two freely rotating heated wheels each disposed at a substantially 45° angle to the horizontal on opposite sides and facing inwardly of the bag to open cuts along the lower edges of the bag by a combination of heat and pressure without burning of the bag or its contents. The free rolling cutter wheel movement minimizes relative motion between the cutting edge and bag wall, thereby ensuring steady, well controlled, contact time for the cutting action. After two parallel cuts have been made by the longitudinal cutters at a subsequent cross-cut area, a heated transverse cutter, which can also be in the form of a heated wheel, but is preferably an elongated drill blade, connects the two longitudinal cuts to make an "H" or "U" shaped arrangement of cuts in the bottom side of the bag. The table on which the bag is resting when the transverse cut has been completed has a hinged door arrangement, so that upon opening of the door or doors, the bag contents can fall into a hopper or other container beneath the table.

While the bag contents are dropping out, the bag itself is supported from above by means of a bag engaging head which holds the upper side in place by mechanical engagement of spikes that pierce the upper wall of the bag. Some of these spikes are hollow air spikes that aid in discharge of the contents by blowing air into the bag. After emptying, the open bag is removed from the cutting area, preferably by means of a cooperating arrangement of rolls and a reaction plate, for disposal, as by baling, and to make room for the next bag to be emptied. An air logic circuit can automatically control operation of the cooperating pistons, gates, doors and cutters for coordination of the movement of bags through the system. An emergency override arrangement is provided for such contingencies as quick clearing of a "bad" bag from the apparatus.

In an alternative embodiment of the invention particularly suited to handling unusually heat sensitive materials, the longitudinal and transverse cuts are made by a pair of scissor-like cutters.

As a further alternative, the transverse cut can be made by a heated roller which is moved upwardly into contact with the bag at one of its sides, and then moved swiftly across the width of the bag.

In a presently preferred embodiment of the apparatus, each bag to be emptied is conveyed into the machine by an intermittently operated belt conveyor, which projects through an opening at an end of the machine and drops the bags one at a time, as they lie on one of their larger faces on the conveyor, on to a hinged and dropable vibrator table on which the bag is centered and its contents compacted by vibration. Centering of the bag on the table is effected first in the longitudinal direction by laterally inward movement of a parallel pair of oppositely disposed, transversely extending heated straight edge cutters between which the bag is situated and which will produce the transversely extending cuts on the forward and rearward end edges of the bag, about 1" or 1½" above the downwardly facing bag face. As this longitudinal centering of the bag is completed, and momentarily before the transverse cuts are made, a flat clamping plate engages the upwardly facing wall of the bag, pressing the bag and its contents against the vibrator table, thus squaring and holding the bag to ensure that "clean" cuts are made by the transverse cutters which then press into the bag momentarily from opposite directions.

After the pair of oppositely disposed transverse cuts are made the transverse cutters are backed away, the gripping plate is raised, and a heated, longitudinally extending straight edge cutter and a parallel, oppositely disposed longitudinal perforator are moved concurrently and laterally in opposite directions into contact with the respective longitudinal side edges of the bag, first to center it in the transverse direction whereupon a spiked gripping head now pierces an grips the upwardly facing bag face, and then to simultaneously cut one longitudinal edge between the previous transverse cuts and perforate the other longitudinal edge to form a line of perforations between the previous transverse cuts, thus forming a hinged, U-shaped flap of the downwardly facing bag wall.

While the bag continues to be gripped by the spiked gripping head, the vibrator table is pivoted 90° downwardly to permit the bag flap to open and the bag contents to fall into a discharge chute or hopper therebelow. A short burst of compressed air through a plurality of air nozzles, interspersed with the gripping head spikes, ensures complete emptying of the bag contents.

Return of the pivoted table to its horizontal position preceded by further downward movement of the gripping head sandwiches and compacts the bag between the two and readies the empty bag for discharge.

Discharge of the bag is effected laterally to the side of the machine by first raising and then tilting the gripping head which holds the empty bag. A "stripping" movement of the gripping head, by which the aforementioned clamping plate is again moved to a position below and thus concealing the bag gripping spikes, strips the empty bag from the tilted head and into a bag discharge chute for gravity removal from the machine.

The gripping head is then returned to its vertical position with its clamping plate properly disposed for pressure-clamping of the next filled bag during the transverse cutting thereof, as previously described.

These and other objects, features and advantages of the invention will be more fully understood from the following detailed description, when read in conjunction with the several figures of the accompanying drawings.

FIG. 23 is a sectional view of longitudinal cutters according to one embodiment of the invention, showing their relation to a bag being cut;

FIG. 24 is a side view of a rotary transverse cutting arrangement according to one embodiment of the invention;

FIG. 25 is a plan view of the cutting arrangement of FIG. 24;

FIG. 26 is a detail view of a baffle arrangement used in the arrangement of FIGS. 24 and 25;

FIG. 36 is a top view, partially in section, of an end-stop sensing mechanism incorporated in the FIG. 1 apparatus;

FIG. 43 is an end view in elevation of the cutting device of FIG. 42, partially broken away;

FIG. 46 is an end elevational view taken along line 46—46 of FIG. 45, and illustrating certain features of the operation of the apparatus;

FIG. 47 is a perspective view from the underside of a typical full bag which will be opened and emptied using the apparatus of FIG. 45;

Figure 45:
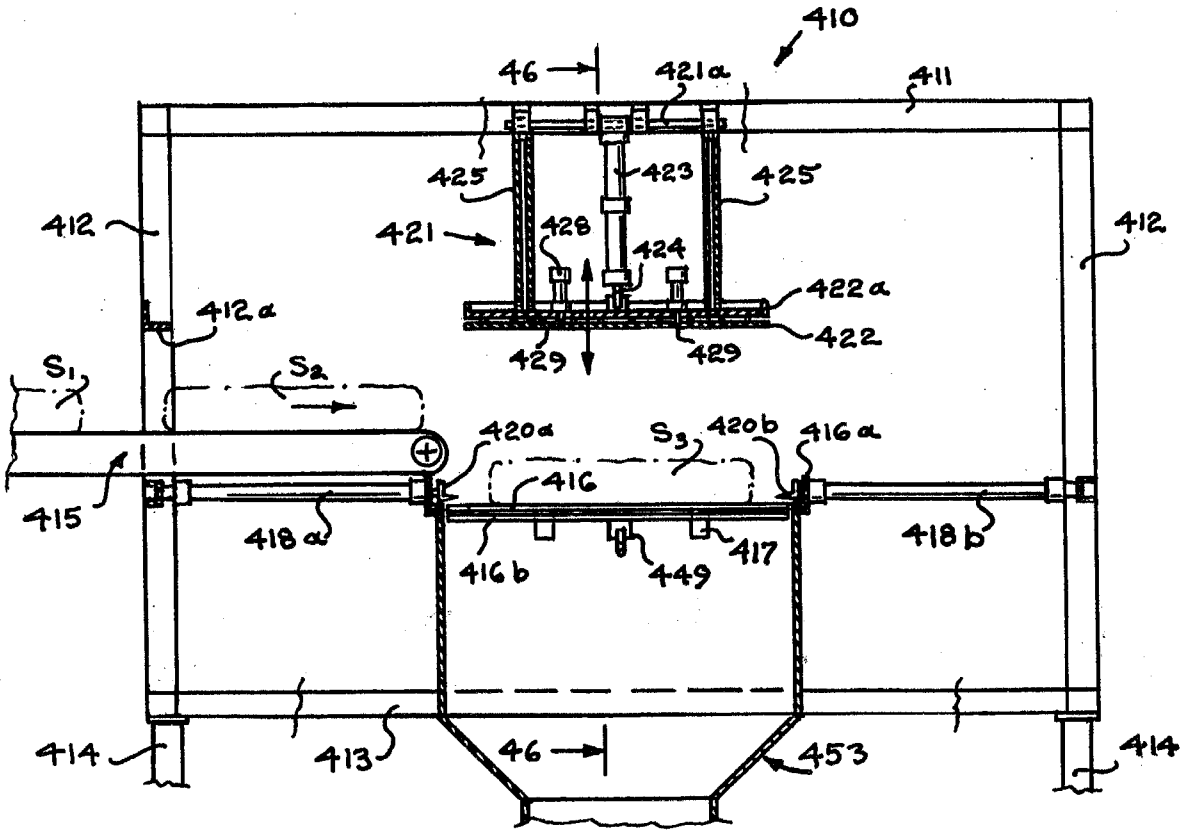
FIG. 45 is a fragmented side view of a bag opening and emptying apparatus according to another, preferred embodiment of the invention, with certain parts cut away and with bag positions shown in dashed lines.
Figure 48:
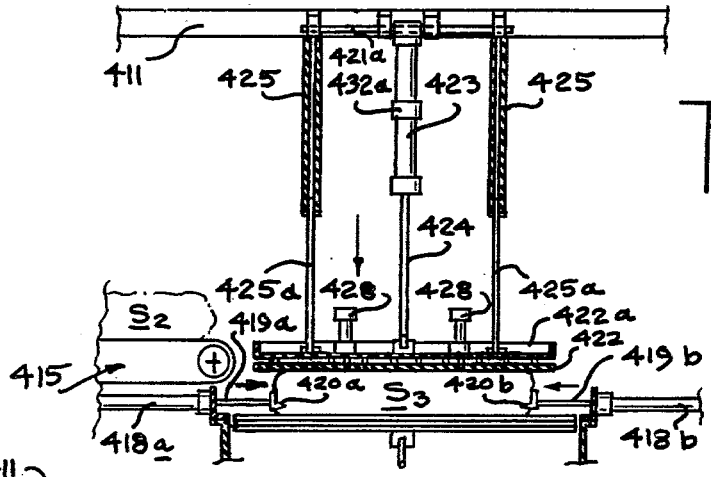
FIG. 48 is a fragmented side view of a portion of the apparatus as shown in FIG. 45, but in a different position during operation.

FIGS. 49–52, inclusive, are fragmentary end views of the parts emphasized in FIG. 48 which, together with FIG. 48, show their sequence of operation;

FIGS. 53 and 54 are additional end view showings of the apparatus of FIGS. 45–48, showing further sequences of operation;

FIG. 55 is an enlarged perspective view of a segmented-blade type cutter providing a straight cutting edge;

FIG. 56 is a fragmented perspective view similar to FIG. 55 showing an alternative, preferred segmented type straight edge cutter, in which each blade segment has scalloped configuration;

FIG. 57 is a further enlarged cross-sectional end view as seen from line 57—57 in FIG. 55;

FIG. 58 is an enlarged perspective showing of a hinge line perforator bar as is a feature of the apparatus of FIG. 45;

FIG. 59 is a further enlarged cross-sectional end view of the perforator bar as seen from line 59—59 in FIG. 58.

DETAILED DESCRIPTION OF EMBODIMENTS OF THE INVENTION

Figure 1:
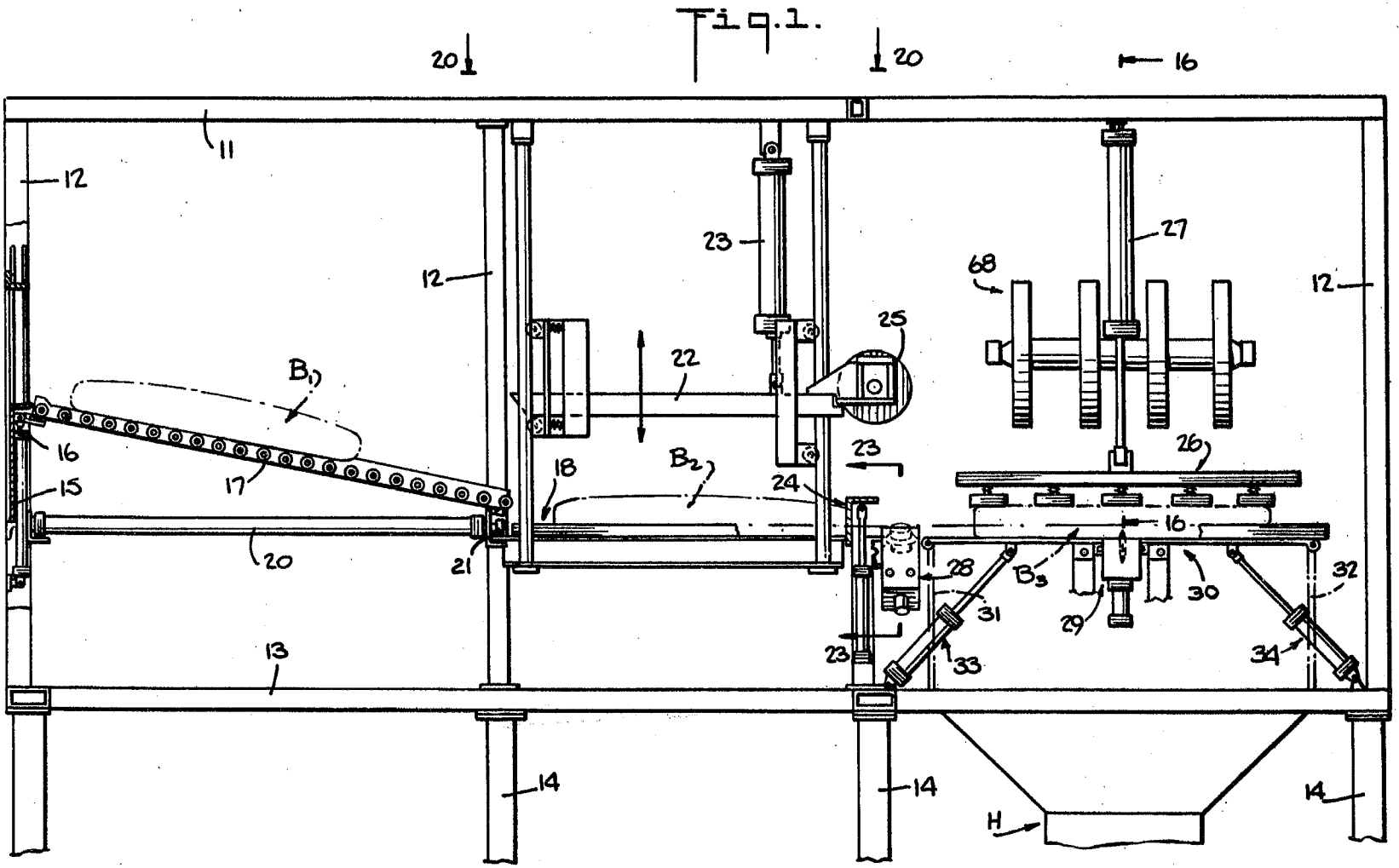
FIG. 1 is a side view of bag opening and emptying apparatus according to one embodiment of the invention, with certain parts cut away and with bag positions shown in dashed lines.

The somewhat simplified overall view of FIG. 1 illustrates apparatus in accordance with one embodiment of the invention. In FIGS. 1–44 the bags whose contents are being removed are generally designated by the reference character "B". Such bags B are shown in three stages of the bag opening process at $B_1$, $B_2$, $B_3$ in FIG. 1. The bag at $B_1$ has just entered the apparatus of the invention from a supply of full bags. The bag $B_2$ is at a stage where the bag and its contents are shaken and "squared" so that it is uniformly presented for opening and emptying as is necessary for best operation. The bag at $B_3$ has been cut in one direction and is at a second cutting position, where, after the second cutting, its contents are removed. From its position at $B_3$, after emptying, the bag B will be discharged from the apparatus and collected with other empty bags.

As shown in FIG. 1, the various bag processing mechanisms of the invention are supported by a sturdy structural frame including overhead frame structure 11, vertical beams 12, lower transverse frame structure 13, and a plurality of supporting posts 14. The particular structural frame construction shown in FIG. 1 is merely illustrative of a typical installation of the apparatus and can be varied to suit the requirements of the building wherein the apparatus is to be installed. It will be noted, however, that the frame structure shown lends itself to enclosure of the apparatus to isolate the apparatus from the environment as a closed system. Although not illustrated, it will be understood that appropriate, dustproof paneling is mounted on the frame structures 11, 12 and 13 for the purpose.

The bags enter from the left in FIG. 1 through a normally closed door 15 shown in its open position with its vertical actuating cylinder 16 in retracted condition. After a bag has passed through the doorway of the door 15 the cylinder 16 pushes the door up to a closed position. After passing through the door 15 the bag at $B_1$ travels forward and down a roller conveyor generally designated 17 and falls off the conveyor 17, landing on a table at 18 and impacting a cushioned stop gate 24, thus flattening and squaring the front of the bag for cutting. Additional preparation for cutting will be described hereinafter.

Located beneath the conveyor 17 is a long cylinder 20, the piston 21 of which serves to push each successive bag B forward along the table 18. A top plate 22 flattens the upper side of the bag at $B_2$. A piston and cylinder assembly 23 raises and lowers the top plate 22 for entry of the bags B and is later raised after the bag has been moved from table 18. The leading end of the bag at $B_2$ can be seen to be initially restrained from forward motion by the retractable stop gate mechanism 24, which functions immediately after impact by the bag. While the bag rests at $B_2$, vibrating means shake down the bag contents and other squaring means to be described hereinafter cooperate with the top plate 22 to form the successive bags into uniform squared shape for opening, the bag front ends having been squared by the stop gate 24.

After shaping and squaring, each bag is urged forward by the piston 21 to the position shown at $B_3$, while passing under a free rolling or powered pinch roll 25 and between longitudinal free rolling heated cutters 28.

At $B_3$, a bag engaging head assembly generally designated 26 is lowered into bag holding position, where the head 26 holds up the bag by mechanical engagement with the bag's upwardly facing side surface. A piston and cylinder activating mechanism for raising and lowering the head 26 is shown at 27.

Under the bag at $B_3$ is a hopper H for receiving the bag contents when the bag has been opened by cuts at its lower side edges, joined by a transverse cut. A longitudinal cutter 28 and one form of transverse cutter 29 are shown in FIG. 1 and will be described in greater detail in conjunction with more detailed figures of the drawing. It will only be noted here that in several embodiments of the invention shown, these cutters are heated to open cuts through the bag walls by a combination of heat and pressure. The hot cutting edges of the bag cutters are heated to a temperature of from about 800° F. to about 1000° F., preferably to a temperature within the range of 850°–900° F., for cutting the bag without igniting the bag or its contents.

During cutting, a table 30 supports the bag at $B_3$. This table 30 comprises a pair of hinged door parts 31, 32, mounted for pivotal movement to the positions shown by dashed lines in FIG. 1 so that the bag contents can drop into the hopper H after cuts have opened the lower side of the bag B. Cylinder and piston mechanisms generally designated 33 and 34 operate the trap doors 31, 32. Full 90° movement of the door parts 31, 32 assure complete emptying of the bag contents. Means not shown in FIG. 1 then remove the emptied bag from the position at B3 and the next bag is pushed into position for opening.

Figures 2, 17:
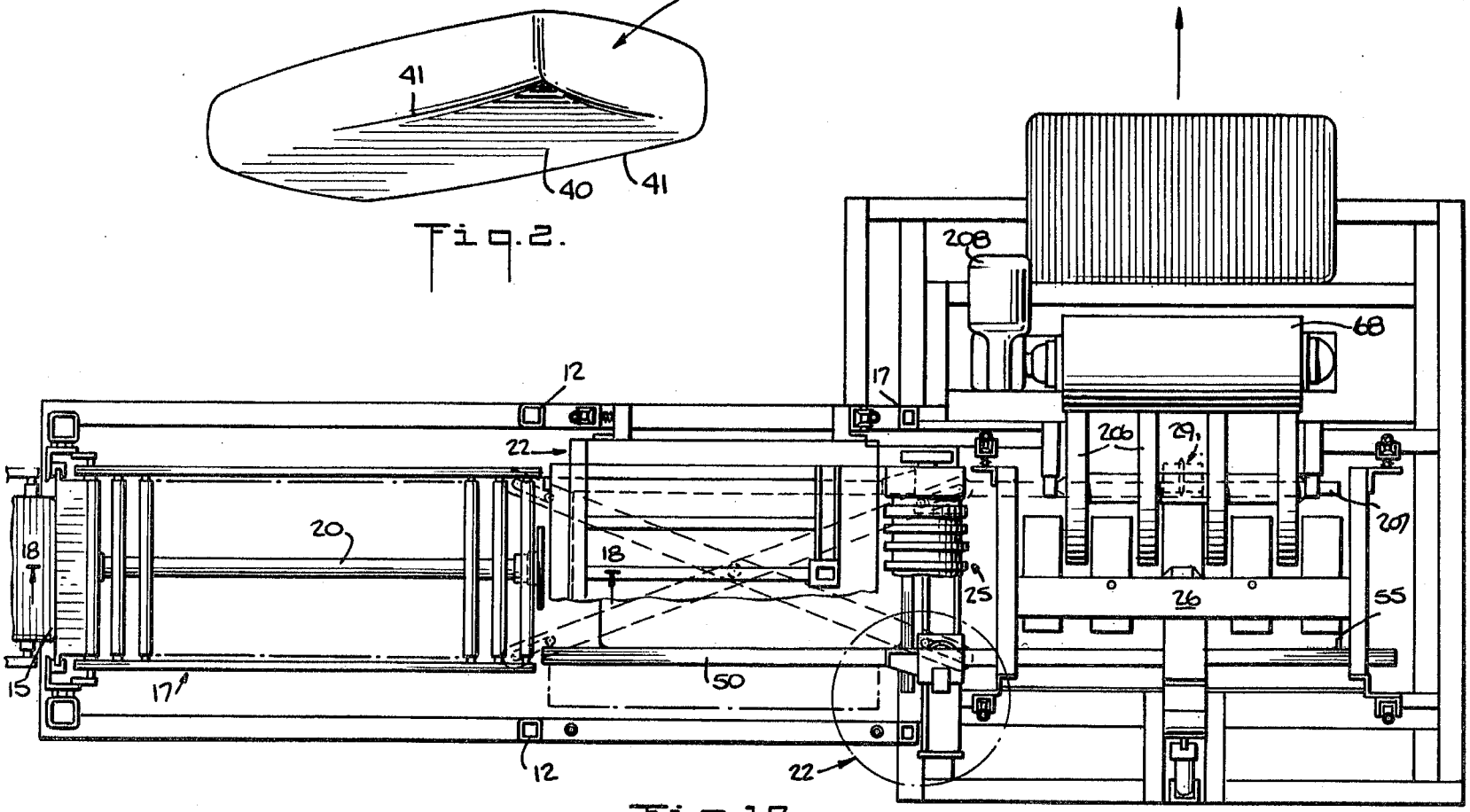
FIG. 2 is a view in perspective of a typical full bag which will be opened and emptied using the apparatus.
FIG. 17 is an overall view from above of the apparatus of FIG. 1.

FIG. 2 shows a typical bag B of the kind that can be very effectively handled by the method and apparatus of the invention. It will be seen that the full bag B of FIG. 2 has general form of a parallelipiped of somewhat rounded contours with a generally rectangular downwardly facing side face 40 and lower longitudinal edges 41. Industrial and commercial bags of this type used for storage and shipment of bulk goods generally range in size from about 3" by 14" by 20" to about 12" by 28" by 48", and the various parts of the apparatus described are suitably proportioned to accommodate bags of this range of sizes, though of course the apparatus could be of greater or smaller dimensions for particular applications.

Before discussing the details of the various mechanisms and devices employed in the apparatus of the invention, reference is made to the schematic illustrations of FIGS. 3–16 which illustrate the process of the invention in the step-by-step handling of a single bag B.

Figures 3, 4, 5, 6, 44:
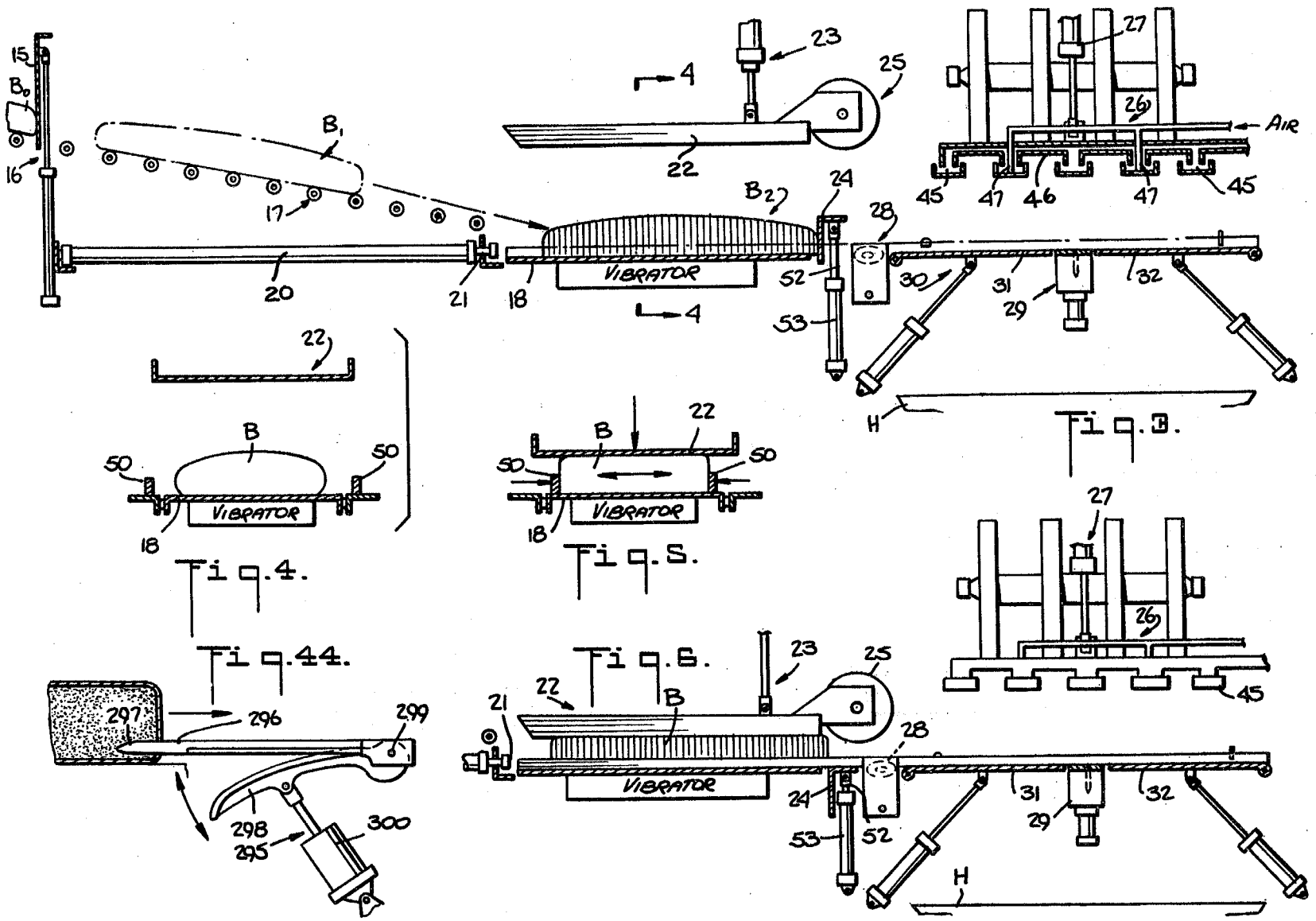
FIG. 3 is a somewhat schematic side view of the apparatus of FIG. 1.
FIG. 4 is a view in section taken along line 4—4 of FIG. 3 and looking in the direction of the arrows.
FIG. 5 is a view similar to FIG. 4 but with the means for squaring and flattening a bag in operation.
FIG. 6 is a view similar to a portion of FIG. 3 in the condition of FIG. 5.
FIG. 44 is a detail view of an alternative form of cutter of the invention.

In FIG. 3, the bag at $B_2$ has arrived at the table 18 after entering through the door 15 and passing down the roller conveyor 17 as indicated by the bag B1 shown in dashed lines. It will be seen that the door 15 has been returned to its upper, closed, position under actuation by the piston 16 and that another bag $B_o$ is waiting at the door 15 for admission when the door 15 opens again. The long piston 21 is retracted within its cylinder 20 and the bag at $B_2$ has its forward end abutting the gate 24, which is in its raised position. A vibrator is mounted on the underside of the tube 18 as indicated to vibrate the table for shaking down the contents of the bag at $B_2$. Above the bag at $B_2$, at its elevated position, a top plate 22 is shown with a pinch roll 25 mounted for movement with the top plate 22 upon extension of the piston 23.

Ahead of the position of the bag $B_2$ the table 30, with its hinged doors 31 and 32, awaits the entry of a bag. The bag engaging head 26 is in its raised inoperative position. It can be seen that the head 26 has a plurality (five are shown as typical) of transversely oriented elongated modules 45 interconnected via a longitudinally extending member 46 and carrying spike means for supporting a bag by engaging its upper side face. Downwardly pointing hollow spikes 47, communicating with an air line as indicated, are provided for forcing air under pressure into a bag to aid in removal of the bag contents when the bag has been cut open.

FIGS. 4 and 5 show the action of the flattening and squaring device at the vibrating table 18. In FIG. 4 the bag is shown in the condition it has in FIG. 3 before the squaring operation. Side squaring guides 50 are elongated members aligned parallel to the direction of travel of the bag B. As shown in FIG. 5, these squaring guides 50 move transversely inward to squeeze in against the vertical sides of the bag, after which the top plate 22 descends and flattens the top of bag B and the vibrator shakes the bag contents to fill the bag corners and settle the contents fully.

FIG. 6 illustrates the bag B in the squared condition that results from the action of the side squaring guides 50 and top plate 22. It will be noted that in FIG. 6 the stop gate 24 has been lowered by the retraction of a vertically disposed piston 52 into its cylinder 53, this piston 52 being shown extended in FIG. 3. The pinch roll 25 is now in position to engage the bag B when piston 21 pushes the bag forward, since the lowermost position of the surface of the roll 25 is slightly below the level of the top plate 22 that carries the roll 25.

Figures 7, 8, 9, 10:
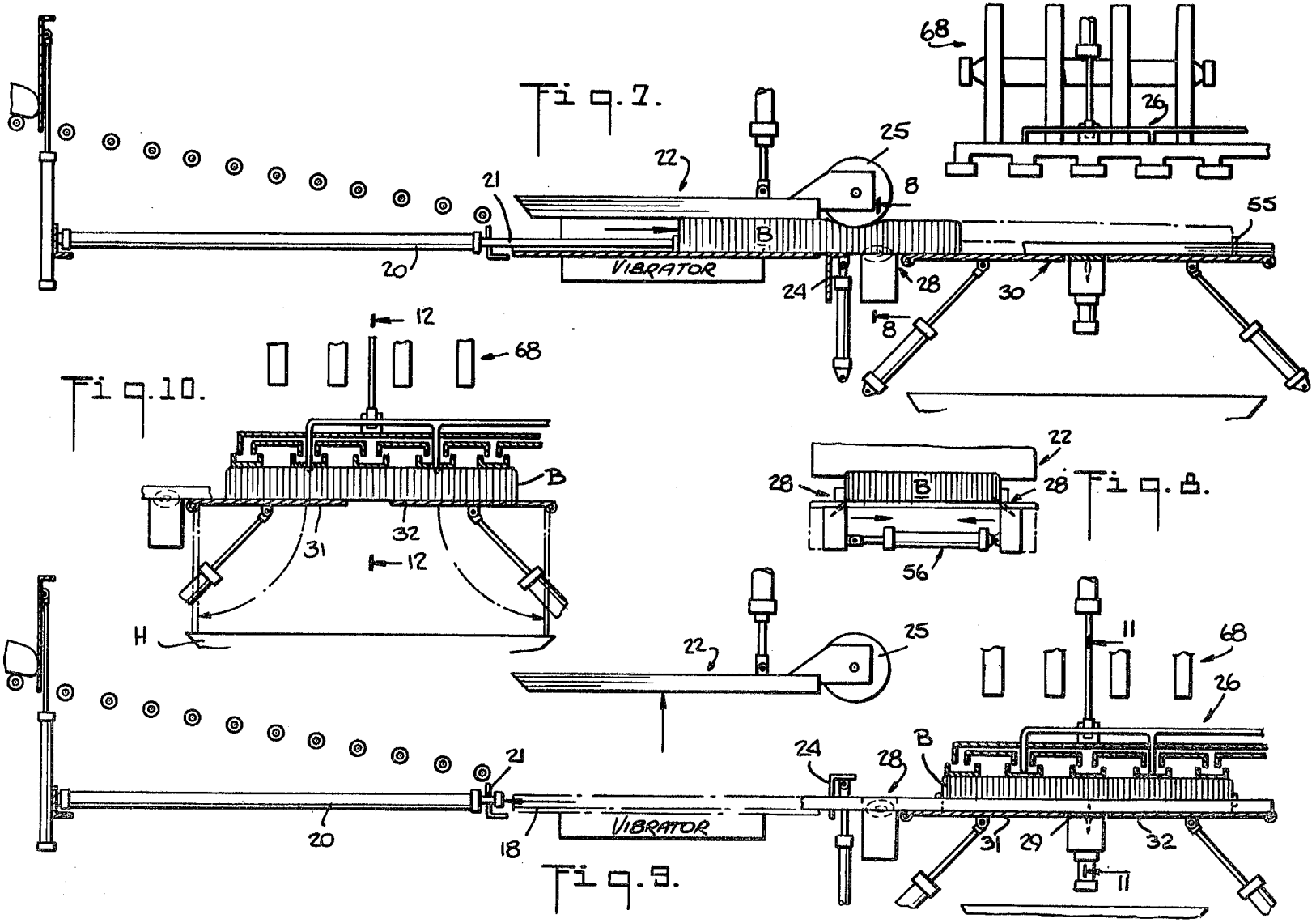
FIG. 7 shows the apparatus of FIG. 3 at a step of the bag opening operation following that of FIG. 6.
FIG. 8 is a view in section taken along line 8—8 of FIG. 7 and showing the action of longitudinal cutting wheels in the apparatus of FIG. 1.
FIG. 9 is a view similar to that of FIG. 3 at a stage at which longitudinal cutting has been completed but the cross cut has not been made.
FIG. 10 is a side view of the bag emptying station of the apparatus of FIG. 1 at a condition immediately after that of FIG. 9.

The succeeding stage of the process is shown in FIG. 7, wherein the piston has begun to push the bag forward to the cutting table 30. The longitudinal cutting devices 28 have begun to cut lengthwise along the side edges of the bag B as it passes between them, restrained against upward motion by the spring loaded pinch roll 25. The final forward position of the bag is shown by dashed lines in FIG. 7. When the bag has reached the location indicated in dashed lines it contacts a back stop sensor device generally designated 55 and the head 26 moves down and engages the bag.

FIG. 8 shows the longitudinal cutters 28 in action, cutting open the bag along its lower side edges. Piston and cylinder means 56 restraining the cutters 28 so that they exert cutting pressure against the bag appear in FIG. 8.

It will be understood that by the time the bag has reached the position indicated in FIG. 9, the whole length of the bag has passed the position of the longitudinal cutters, the bag having been pushed forward by the extension of the piston 21, which is then retracted as shown by the arrow.

At this stage, the transverse bag cutter 29 is ready to produce a cross cut joining the two longitudinal cuts. The head 26 is in its lowered position in FIG. 9, to impale the bag on its spikes and ready to support the bag when the table doors 31, 32 open to spill the contents of the bag into the hopper H. It will also be seen that the piston 21 has been withdrawn at the stage shown in FIG. 9, ready to engage and push forward a next bag for squaring, opening and emptying of the contents. The top plate 32 has been raised to allow a following bag to enter on to the table 18 and the stop gate 24 has been raised.

Figures 11, 12, 13, 14, 15, 16:
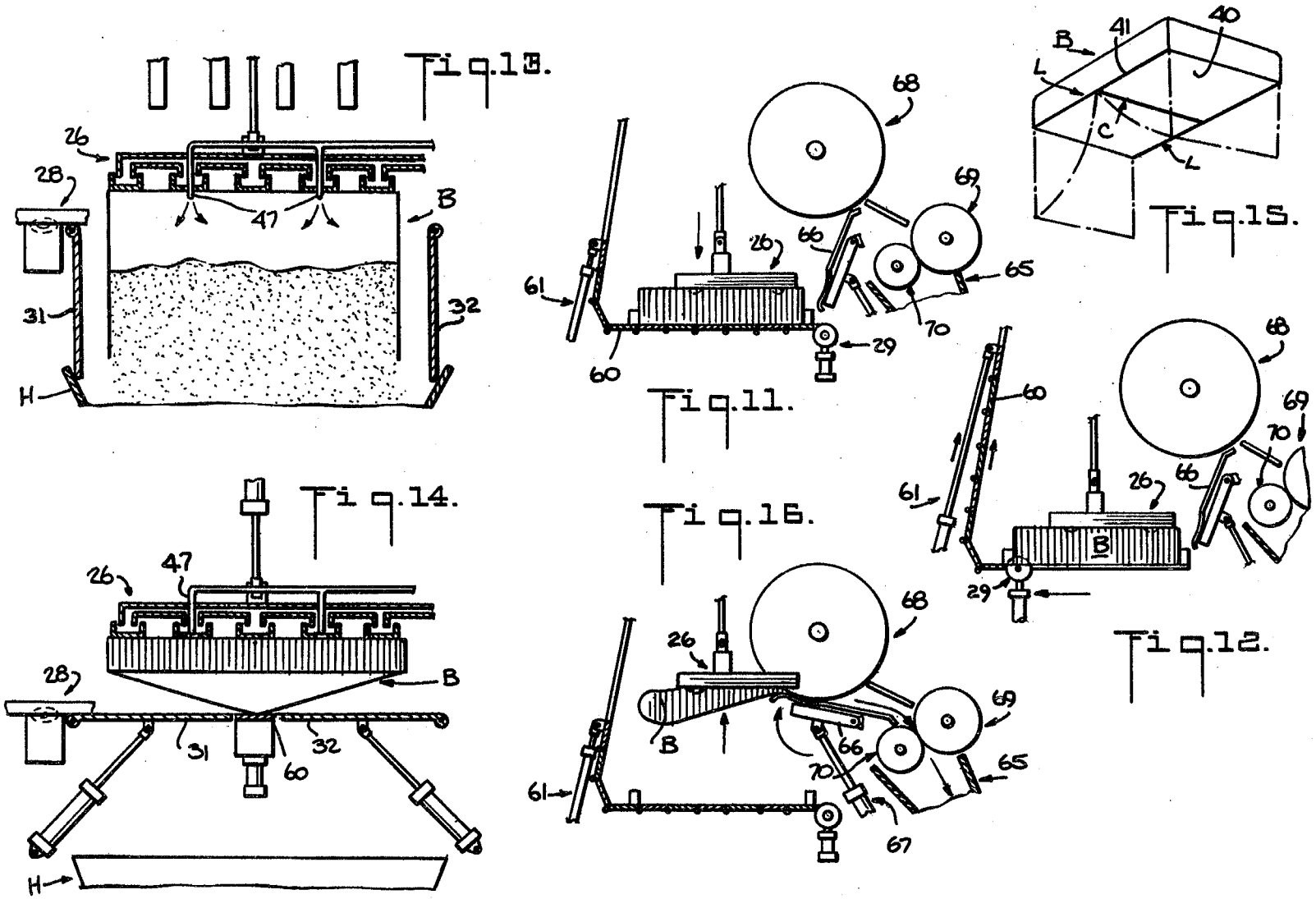
FIG. 11 is a view toward the front end of a bag in the condition of FIG. 9.
FIG. 12 is a view similar to that of FIG. 11, but in the condition of FIG. 10.
FIG. 13 is a view similar to that of FIG. 10 but at a subsequent step of operation of the apparatus of FIG. 1 at which the bag has been picked up for emptying.
FIG. 14 shows the condition of the apparatus of FIGS. 10 and 13 after a bag has been emptied.
FIG. 15 shows the manner in which a bag opens for emptying in accordance with the embodiment of the invention shown in FIG. 1.
FIG. 16 is a view similar to that of FIG. 11 with the bag discharging mechanism in operation.

The bag emptying operation can be explained with reference to FIGS. 10–12, in which FIG. 10 shows a cut bag B ready to discharge its contents upon lowering of the trap doors 31, 32. The views of FIGS. 11 and 12, taken at a right angle to that of FIG. 10 and rearward along the direction of travel of a bag to the cutting table 30, show how one form of transverse cutter 29 follows a segmented "garage door" middle section 60 of the table 30 across the width of the bag when the "garage door" is activated by a cylinder and piston 61. In FIG. 11 the cross cutter 29 has not yet begun to traverse the bag and in FIG. 12 the cut has ben completed.

In a preferred embodiment of the invention, the garage door and rotary cutter arrangement is replaced by an elongated heated knife to be described hereinafter in conjunction with certain figures of the drawing, but for some applications the rotary transverse cutter 29 may be advantageously employed.

The emptying of the bag, upon pivotal opening of the trap doors 31, 32, is shown in FIG. 13. The bag B, now cut open, is supported by means carried by the head 26 while horizontally directed air blown through holes in the sides of the air spikes 47 gently loosens contents adhering to the bag interior surfaces and fills the void left as the contents move downward into the hopper H by gravity. After emptying the bag the space between the doors 31, 32 is closed again.

At the stage shown in FIG. 14, the head 26 has been lifted up from its position during emptying of the bag preparatory to the discharge of the empty bag. This occurs simultaneously with the start of door closing and shutoff of the flow of air through the air spikes 47.

FIG. 15 illustrates a preferred manner of cutting open a bag using an H-shaped pattern of cuts, two longitudinal cuts L produced by the cutters 28 and one transverse cut C produced by the cross cutter 29, allowing the bag's lower face to open out downwardly as a pair of flaps shown in dashed lines. In a modified form of the invention, the transverse cut C could be made at one end of the bag B, joining the cuts L to form a U-shaped array and allowing the bottom of a bag B to open as one large flap. Full opening of the bag prevents any obstruction to the downward fall of the contents. In either case, the bags can be efficiently removed by means of the mechanism schematically shown in FIG. 16.

As shown in FIG. 16, after a bag has been emptied and the head 26 has been raised to its elevated position, the empty bag is fed to a disposal chute 65. Bag holding means to be described in greater detail in conjunction with other figures of the drawing are associated with the head 26 to engage the empty bag. A hingedly mounted plate 66, operated by a piston 67, swings up under the side of the bag and holds the empty bag against a large roller device 68. This roller device 68 pushes the bag between cooperating rollers 69, 70 to flatten and feed the bag down the chute 65 upon disengagement of the bag holding means of the head 26. The plate 66 is then lowered and the cycle is ended.

Although the foregoing discussion has generally described apparatus in conjunction with the steps of the bag opening and emptying process of the invention, a more detailed description of various cooperating systems and mechanisms of embodiments of apparatus according to the invention will now be presented, with particular reference to FIGS. 1 and 17–44.

The overall plan view of FIG. 17, in which certain parts have been cut away and in which some hidden parts are shown in dashed lines, can be considered in conjunction with the side view of FIG. 1 to show the relative positions of the various mechanisms depicted in FIGS. 18–44. Thus the entrance door 15 is shown at the far left in FIGS. 1 and 17, and the bag engaging head 26 at the right hand side of the drawing.

Figure 18:
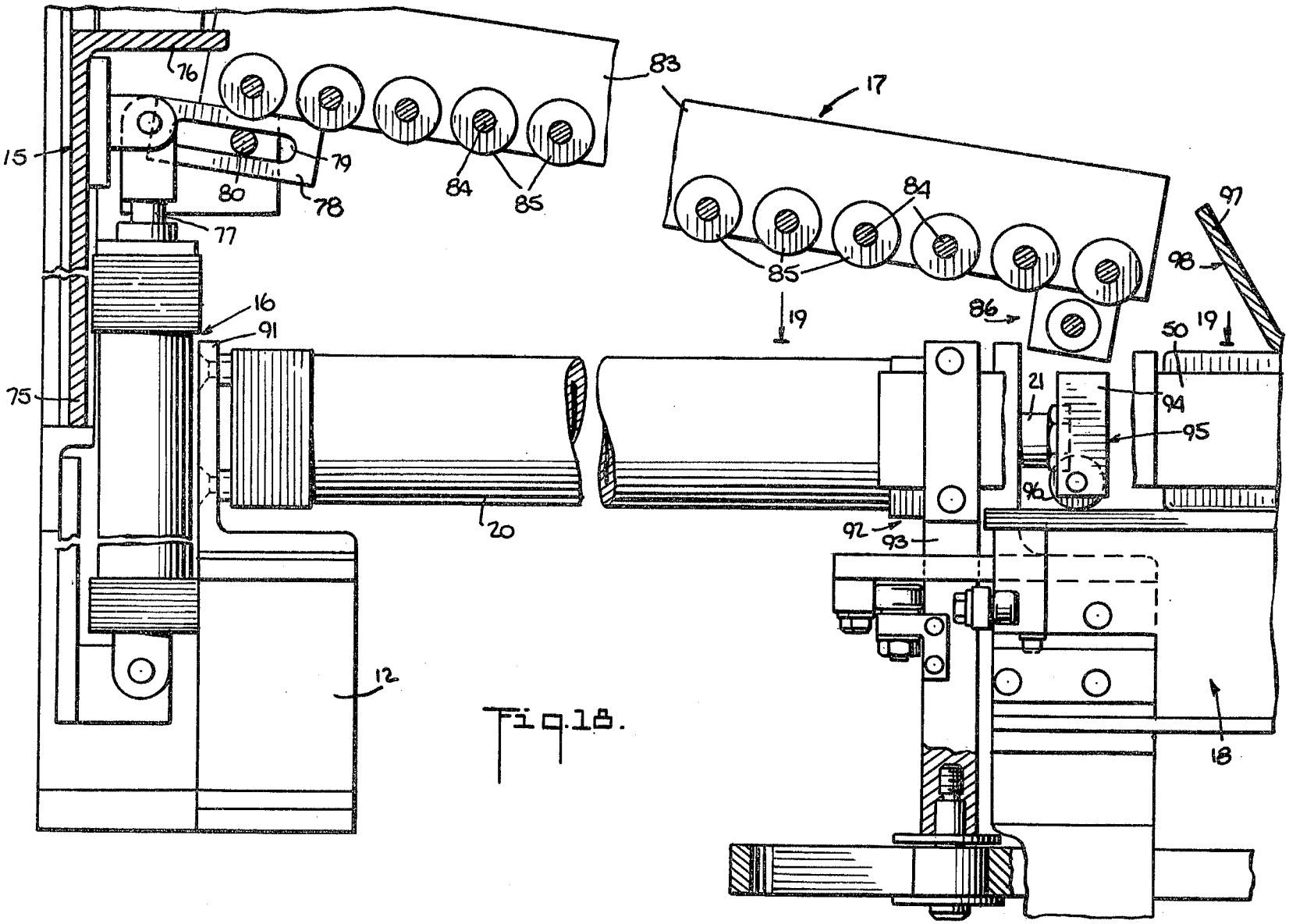
FIG. 18 is an enlarged additional side elevation, partially broken away, showing the infeed end of the apparatus of FIG. 17.

The relationship of the entrance door 15, its actuating cylinder 16, the conveyor 17 and the long cylinder 20 is illustrated in greater detail in FIG. 18. The door 15 has the form of a generally rectangular, vertically disposed panel 75 with an upper end portion 76 bent at a substantially right angle in the direction of entry of a bag. This upper portion 76 of the door 15, and/or the upper frame member of the doorway (not shown) can be suitably padded to prevent possible injury to workmen's hands when the door closes. The generally vertically mounted door actuating cylinder 16 has its piston 77 pivotally secured at its upper end to the door panel 75 below the bent portion 76, for pushing the door upward to its closed position. A bracket 78 having a slot 79 for sliding adjustment of the position of the conveyor 17 holds a pin 80 secured beneath the rear end of the conveyor 17. Although only one side is seen in FIG. 18, it will be understood that a like mounting arrangement is provided at the other side of the conveyor 17.

The conveyor 17 has elongated side rails 83, in which are journalled the shafts 84 of a plurality of equally spaced rollers 85 for conveying the bag down after it passes the door 15. At its forward end the conveyor 17 is mounted on the structural frame by bracket means 86. The arrangement shown is a gravity rolling arrangement, although any gravity chute having low friction could be used.

Beneath the conveyor 17, and firmly secured to an upright structural frame member 12 by means of an angle member 91, is the long cylinder 20 of the bag pushing piston 21. Since the piston 21 serves to push a bag B through the apparatus to the positions where the bag is opened it will be understood that the cylinder 20 is of considerable length. The forward end 92 of the cylinder 20 is also firmly secured to structural main frame members. The piston 21 is shown in its retracted position in FIG. 18, with a thrust plate 94 mounted on the forward end of the piston 21 just beneath the forward end of the roller conveyor 17. The thrust plate 94 has a generally rectangular front surface 95 extending across the width of the apparatus sufficiently to engage the rear end face of a bag and thrust the bag forward. Because of the considerable length of its stroke, the piston 21 is provided with support by rollers 96 mounted for rotation at the bottom of the thrust plate 94.

The table 18 shown at the right in FIG. 18 is mounted for vibratory motion with respect to the frame structure so that the contents of a bag resting on the table can be shaken and settled into the squared shape most suitable for the cutting operation to follow. Above the table 18 is seen the rearwardly and upwardly directed edge portion 97 of the top plate 22. The slanted surface 98 of this slanted part 97 effectively assures that the bag slides under the top plate 22 on its way to the table 18 and stopgate 24. Reference numeral 50 generally indicates one of a pair of side squaring guides, which guides 50 are positioned at opposite side of the path of travel of a bag along the surface of the table 18. The side squaring guides 50 and the top plate 22 cooperate sequentially to square the bag and its contents on the table 18 before the bag is cut open. Beneath the table 18 a vibrating mechanism, such as an eccentrically driven device, causes the table to vibrate while the bag is being squared to settle the bag contents in all the bottom volume, corners and edges of the bag.

Figure 19:
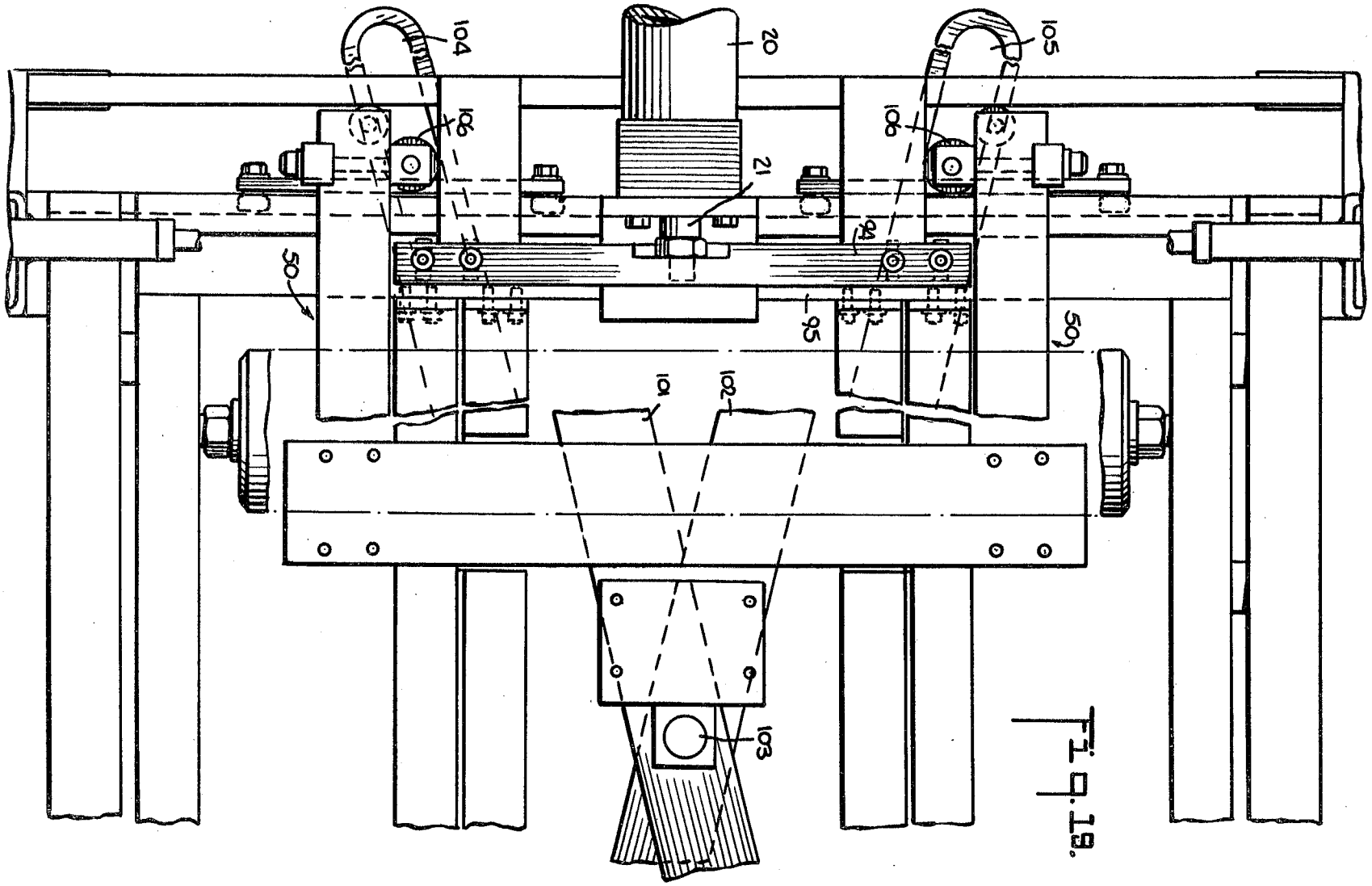
FIG. 19 is a view in section taken along line 19—19 of FIG. 18 and looking in the direction of the arrows.

The structure and operation of the side squaring guides 50 can be understood more fully be considering FIG. 19, wherein the squaring guides 50 are seen to be mounted for lateral movement toward and away from each other through an x-like arrangement of crossed levers 101 and 102 extending beneath the table. The levers 101 and 102 are pivotally interconnected at their point of intersection 103 and the ends of the levers 101 and 102 have elongated slots 104, 105 respectively below the infeed end of the table 18 for sliding engagement with vertically extending rollers 106 mounted for movement perpendicular to the direction of movement of a bag toward the table 18. Both ends of each squaring guide 50 are mounted for movement with the crossed levers 101, 102 so the squaring guides 50 are kept mutually parallel as the angle formed between the levers 101, 102 is decreased to bring the guides 50 closer together, or increased to move the guides apart. When a bag reaches the table 18 the side squaring guides 50 are activated, move inward and confine the sides of the bag as the bag contents are shaken. As will appear more fully in connection with drawing figures showing the longitudinal cutting arrangement, cutting devices are mounted for movement with the squaring guides 50 to insure accurate cutting of bags along their lower side edges.

Figure 20:
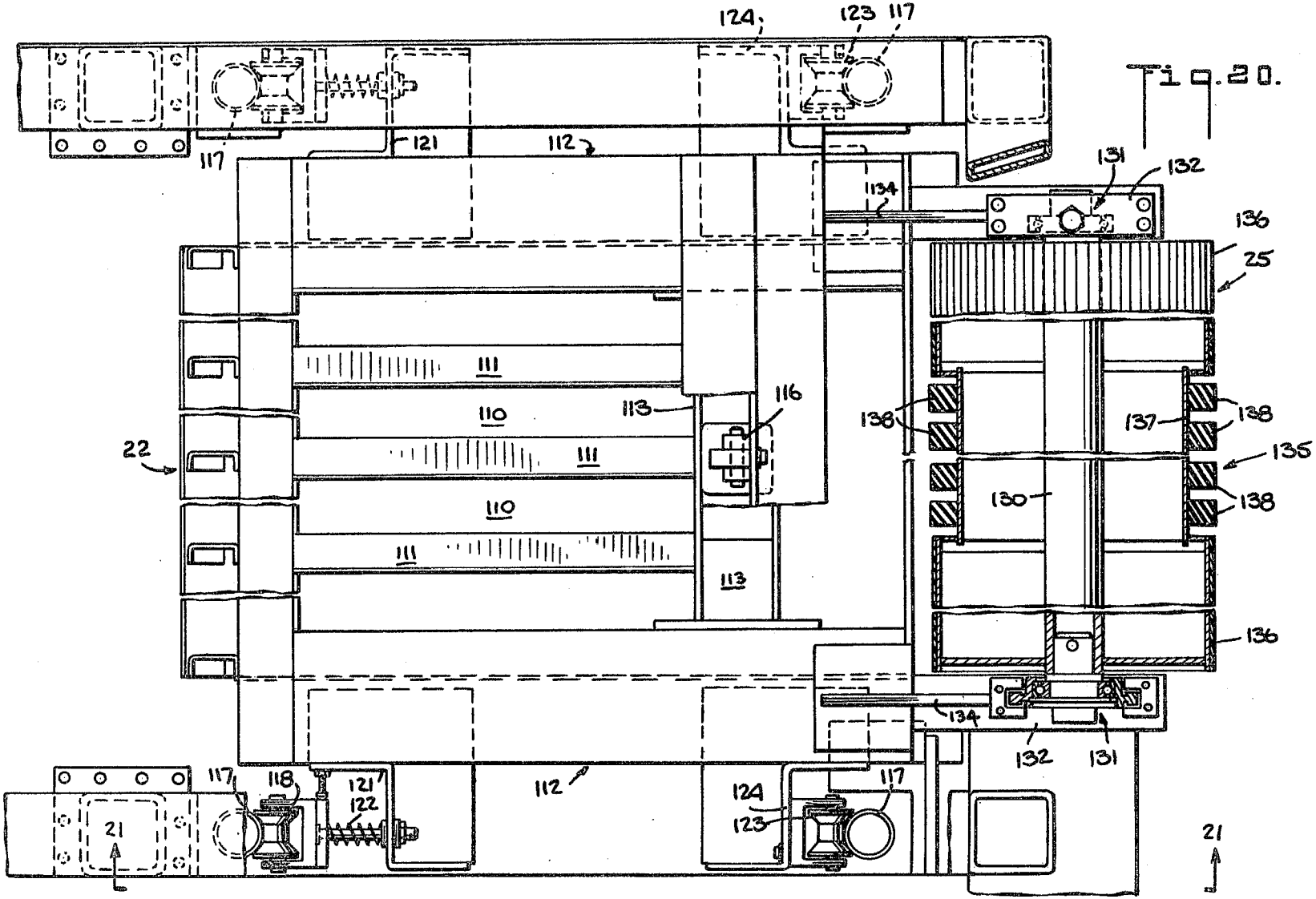
FIG. 20 is a view in section taken along line 20—20 of FIG. 1 and looking in the direction of the arrows.
Figure 21:
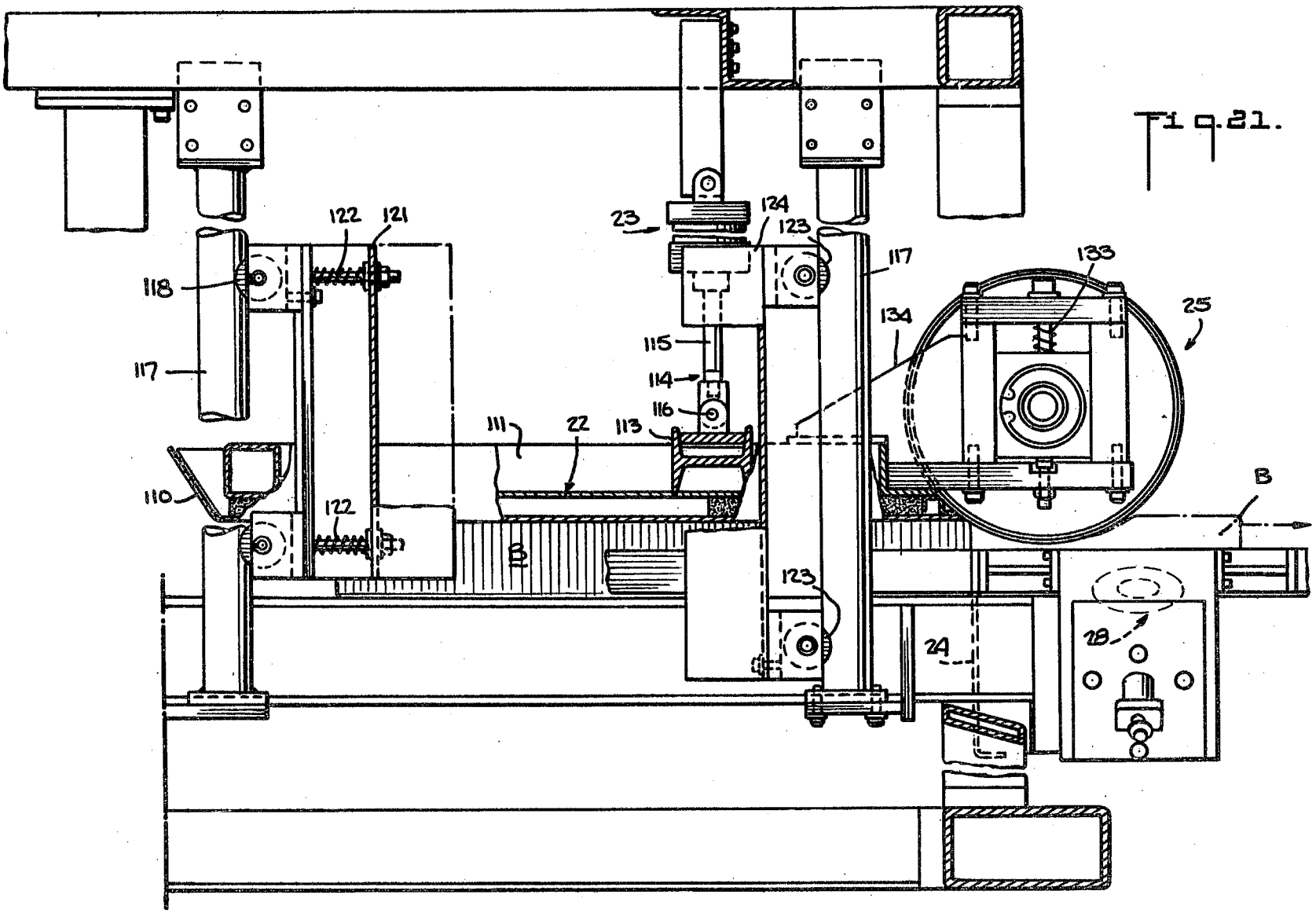
FIG. 21 is a sectional view taken along line 21—21 of FIG. 20 and looking in the direction of the arrows.

The top view of FIG. 20 and the side view of FIG. 21 illustrate the preferred structure for the bag handling apparatus associated with the squaring operation. In these figures, the top plate assembly 22 is shown to be mounted for vertical movement into and out of engagement with the upper surface of a bag by means of the piston and cylinder assembly 23. As shown in FIG. 20, the top plate 110 is a generally flat sheet. The assembly 22 includes a sturdy frame of longitudinal members 111, side frame elements 112 and a cross beam 113 above the top plate 110 and resilient material such as rubber is interposed between the frame structure and the plate 110. The lower end 114 of the piston 115 of the actuating cylinder assembly 23 is secured to the cross beam 112 by a clevis fitting 116. For smooth up and down movement, a roller guide arrangement is provided. Four vertically disposed cylindrical roller guides 117 are provided adjacent the four corners of the top plate 22. These roller guides 117 can be secured to the frame structure of the machine as shown in FIG. 21. At the bag entry end of the top plate 22 the roller guides 117 cooperate with pairs of spool-shaped rollers 118 carried by upright members 121 secured to the side frame members 112 of the top plate 22, and spring-loaded by spring means 122 to keep the rollers 118 in contact with the guides 117. Generally, no such spring means are needed for the rollers 123 carried by uprights 124 at the downstream end of the top plate 22.

FIGS. 20 and 21 also show the pinch roll, generally designated by reference numeral 25 in FIG. 1 and elsewhere. In the preferred embodiment of the invention, the pinch roll 25 is not a simple cylinder, but has a more advantageous structure for best results in its action of backing up bags during longitudinal cutting while aiding in feeding bags through the apparatus. The roll 25 is preferably free rolling but may be driven by a meter (not shown in FIGS. 20 and 21) to urge the bag along.

As shown in FIG. 20, the pinch roll 25 has a central horizontally disposed shaft 130 journalled at its ends 131 in housings 132 with appropriate bearings for smooth rotation. Spring loading means 133 are provided as shown in FIG. 21. The housings 132 are supported by frame means 134 firmly secured to structural members of the top plate assembly 22. A cylindrical drum 135 mounted on the shaft for rotation therewith has a larger diameter at its end portions 136 than at its middle section 137. It has been found that by providing a somewhat resilient surface at the middle of the roll 25, pressure at the center of the bag can be advantageously reduced, and for this purpose, rings 138, preferably of foam rubber, extending around the roll 25 at its middle section 137 are employed.

FIG. 21 shows the top plate 110 and the pinch roll 25 in lowered condition with a bag B emerging from beneath the roll 25. The stop gate 25 is shown in dashed lines in its open, or lowered position. It will also be noted that the pinch roll 25 is positioned just ahead of the longitudinal cutter 28, whereby the bag B is pressed between the roll 25 and the cutter 28 for effective cutting action as the bag is pushed past the cutter 28.

Figure 22:
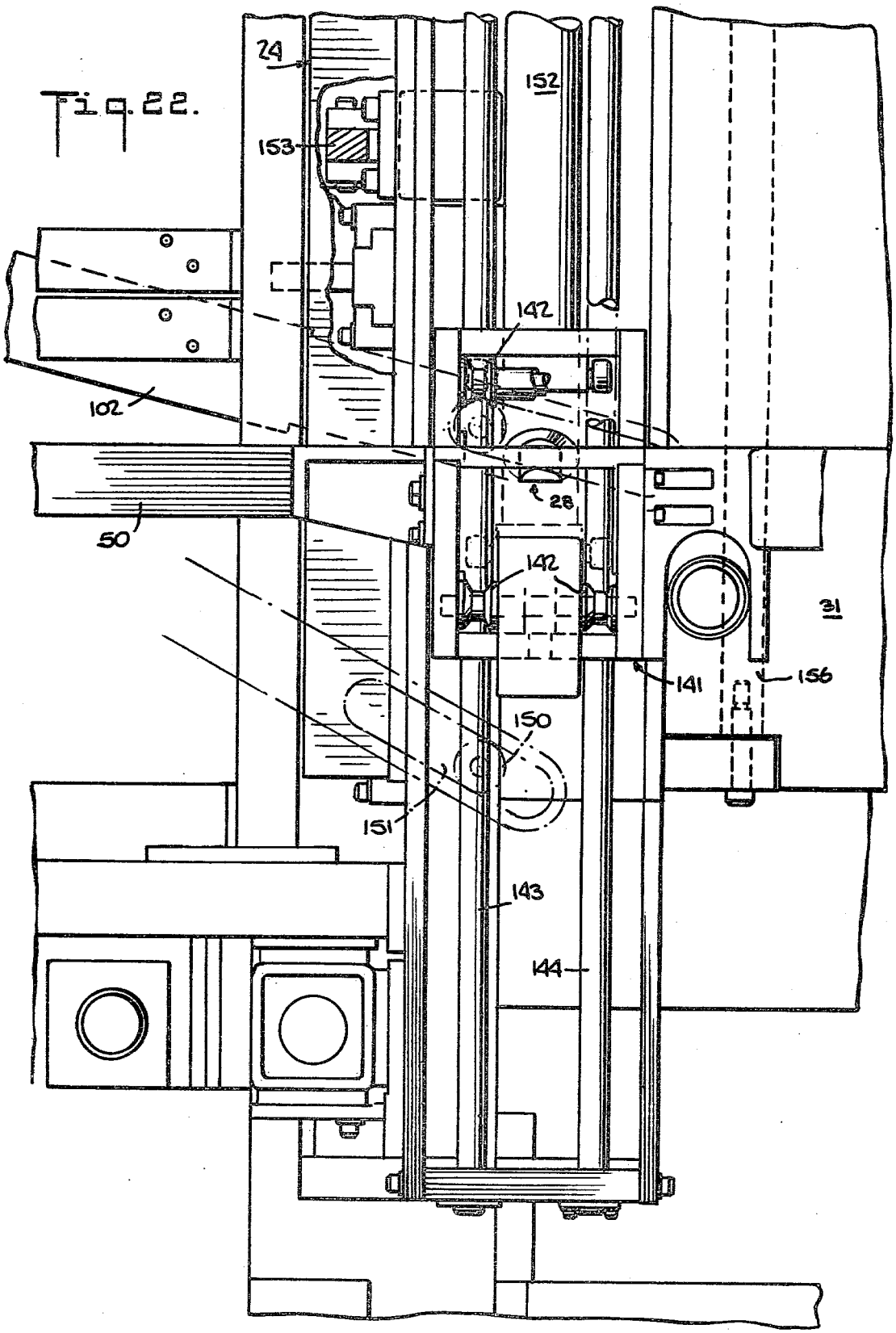
FIG. 22 is a detail view of the area encircled in FIG. 17 with shadow lines indicating two positions of movable parts.

In the description of the cross levers 101, 102 and side squaring guides 50 shown in FIG. 19 it was explained that at their forward ends the squaring guides 50 are also mounted for movement with the cross levers 101, 102. This is shown in FIG. 22 which also illustrates how the longitudinal cutters 28 are moved with the squaring guides 50. FIG. 22 is a view in detail as indicated by the circled area in FIG. 17. The squaring guide 50 is shown to be secured to a carriage 141 mounted to move horizontally and perpendicular to the length of the squaring guide 50. The carriage 141 is shown to be generally box-like and to have four spool-like rollers 142 arranged at its corners to roll along a pair of transversely extending cylindrical tracks 143, 144, which tracks are secured to the machine frame structure. Cooperting lower rollers 145, 146 can be best seen in FIG. 23. The carriage 141 also carries a vertically disposed roller 150, similar to the rollers 106 of FIG. 19, riding in a slot 151 at the forward end of the cross lever 102. Lateral movement of the carriage 141 carries the cross lever 102 along as indicated by the dashed line showing of two positions of the cross lever 102 in FIG. 22. A symmetrical arrangement is provided at the opposite side of the machine from that shown in FIG. 22, so that when the side squaring guide 50 and lever 102 are moved to the left and clockwise respectively, in FIG. 22, the other cross lever 101 moves toward the right and counterclockwise because of the scissor-like pivoted connection of the cross levers 101, 102. A pneumatically operated piston 152 of the piston and cylinder assembly 56 secured to the carriage 141 serves to move the carriage 141. The stop gate 24 and its vertically oriented actuating piston 153 as well as a sturdy hinge 156 of the door 31 are also seen in FIG. 22.

The longitudinal cutters 38 are shown in greater detail in FIG. 23, wherein a bag B is seen in the process of having cuts made at its lower side edges 41 as the bag passes beneath the pinch roll 25. Both cutters 28 are mounted for movement in carriages 141 as shown in FIG. 22, and are oriented at essentially 45 degree angles with respect to vertical to best engage the bag B for longitudinal cutting. This cutting is done by heated cutting wheels 159. Each wheel 159 has a cylindrical body 160 with a protruding central annular cutting edge 161. The wheels 159 are mounted on axles 162 journalled in block 163 that is generally U-shaped in cross section as shown. The block 163 is itself slidably mounted in a mating recess 164 of the carriage 141 and the blocks 163 carrying the cutting wheels 159 are urged toward the bag by positive bias spring assemblies 165 and 166. The cutting wheel 159 is heated by electrical resistance heating coils within the cutter body 160 and not illustrated. A flexible line 167 carries electrical wires to provide power for heating and another flexible line 168 carries cooling air to channels provided within the block 163. The cutting wheels 159 are not driven but roll freely against the bag B as the bag is pushed past by the piston 21. A combination of heat and pressure neatly and cleanly cuts the bag. Free rotation and spring loading of the cutters ensures continual contact with uneven bag surfaces for a complete, unbroken cutting action.

As previously indicated the cutting edges are heated to a temperature between 800° F. and 1000° F. and preferably about 850°–900° F. to cut the bag wall material without ignition of the bag contents. To achieve most effective cutting it has been found that the cutting edge needs to contact the bag at any given area for less than one second and that contact for about 0.4 seconds is very effective. This can be accomplished by moving the bag forward at about 1 to 1.5 feet per second.

The cross cut that joins the longitudinal cuts to open the bag B can be made by a transverse cutting wheel device 29 as shown in FIG. 24. The transverse cutter 29 has a heated cutting wheel 169 mounted to rotate freely in a housing block **169*a*. A pneumatic piston and cylinder assembly 171 is provided for raising the cutting wheel 169 into cutting position as shown in FIG. 24 and lowering the cutting wheel into a retracted position out of contact with the bag when not cutting. This piston and cylinder assembly 171 is mounted for movement with the housing block 169*a* of the cutter 29 to move across beneath the bag during cutting. The transverse cutter housing block 169*a* has rollers 172 at its four corners riding on rails 173. When the doors 31 and 32 that support the bag during cutting are in the horizontal position shown in FIGS. 24 and 25, further rails 174 mounted beneath the leading edges of the doors 31, 32 meet end-to-end with the rails 173 to provide a continuous track, and as shown in FIG. 27, rails 175 on the opposite side of the machine provide a further extension of the track for the transverse cutter 29**.

The doors 31 and 32 have hinges 156 for pivoting downward through a full 90 degrees. To lock the doors 31 and 32 in their closed, horizontal position, pistons 176 are mounted in pneumatic cylinders 177 for extension as bolts into fittings 178 provided beneath the doors 31 and 32 as shown in FIG. 25. When these bolts 176 are extended and the doors 31, 32 are locked in place, the tracks 173 and 174 are aligned. Four cylinders 177 are preferably employed, one cylinder 177 at each side of each of the doors 31 and 32.

As shown in FIG. 26, the wheel 167 has a cutting edge 182 protruding from a generally cylindrical body 183, and can be raised or lowered as indicated to bring the edge 182 into and out of bag cutting position. The lower, retracted position of the cutting wheel body 183 is shown in dashed lines and the extended position in solid lines in FIG. 26. Pivotally mounted baffles 184 rest on the surface of the wheel body 183 and these baffles are linked by levers 185 to the housing block **169*a*** so that they follow the movement of the cutting wheel 169. The baffles 184 close the space around the cutter body 183 except at the edge 182 and thus prevent catching of a cut or damaged bag in the cutter housing or frame.

Figure 29:
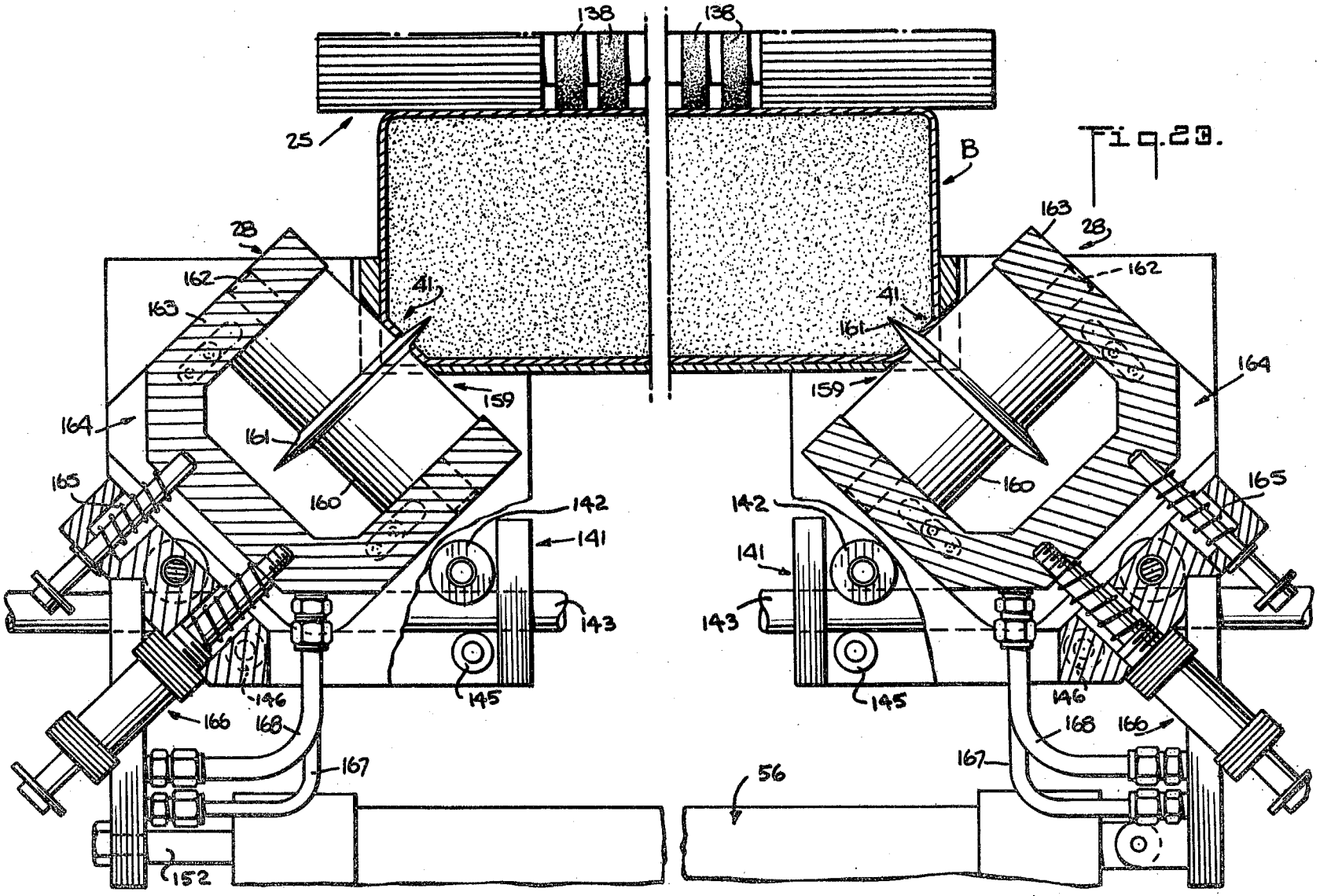
FIG. 29 is a detail view in perspective of a link element shown in FIGS. 27 and 28.
Figures 27, 28, 29:
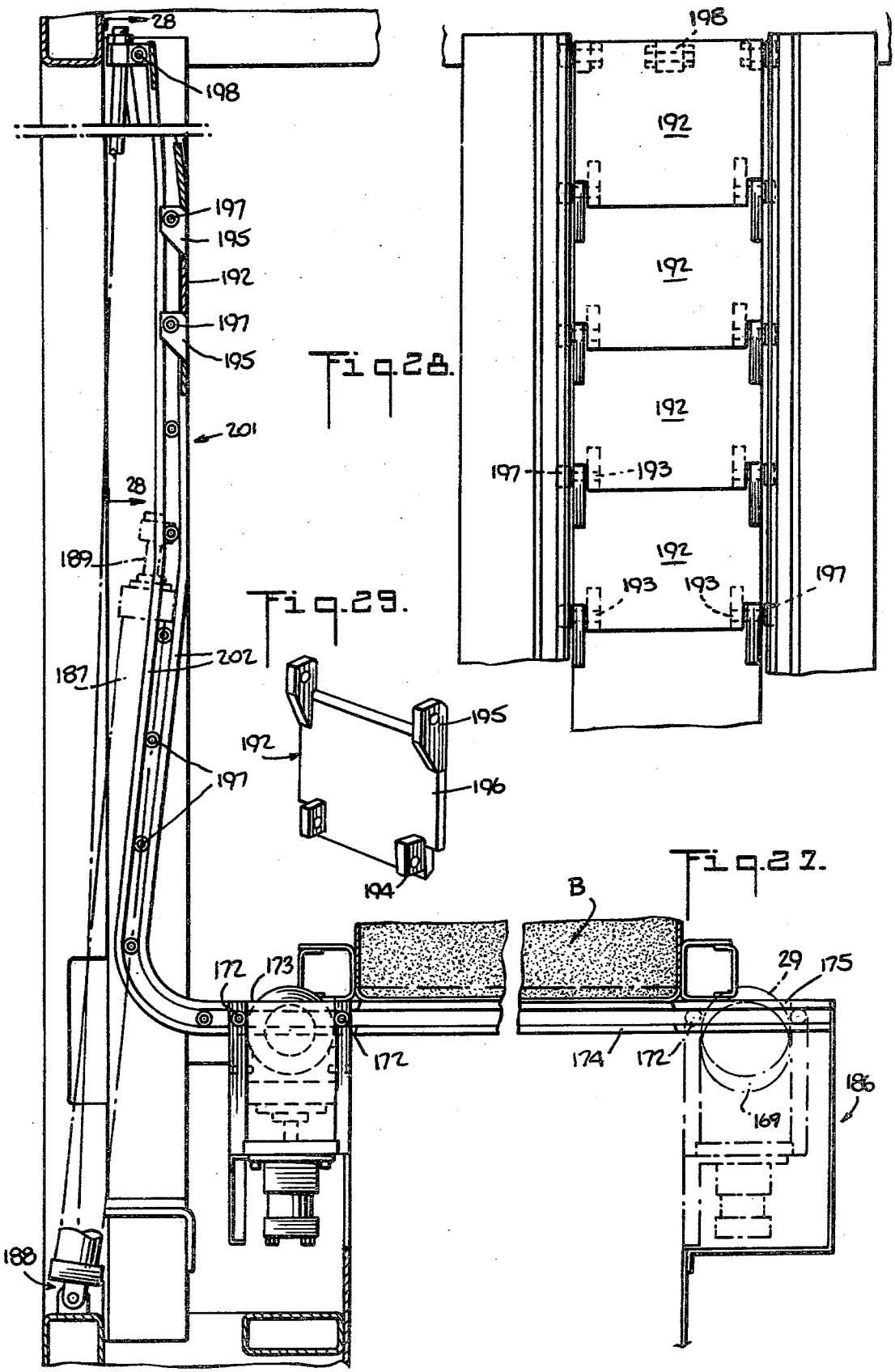
FIG. 27 is a sectional view along line 27—27 of FIG. 24 and looking in the direction of the arrows.
FIG. 28 is a view in section taken along line 28—28 of FIG. 27 and looking in the direction of the arrows.

Reference is now made to FIGS. 27–29, showing a "garage door" arrangement for closing the space between the hinged doors 31 and 32 at the line of passage of the transverse cutter 29. FIG. 27 is a view in section taken at the line of passage of the cutter 29 and looking backward down the path of travel of a bag B to the cutting table 30. The transverse cutter 29 is shown in dashed lines at its starting position at the right of the table 30 in FIG. 27 with its roller wheels 172 on the rail 175. In the starting position the transverse cutter 29 is guarded by a housing 186. It will be understood that the transverse cutter 29 is brought to this starting position with its cutting wheel 169 retracted by traversing the rail section 174 beneath the closed doors 31, 32.

At the left in FIG. 27 there is a generally vertically disposed cylinder 187, pivotally mounted at its lower end 188 to permit some tilting motion. The piston 189 of the cylinder 187 can move from the retracted to the extended positions shown in FIG. 27 to draw the transverse cutter 29 from right to left and, upon retraction, push the transverse cutter back to the left side of the table 30. The means connecting the piston 189 with the cutters 29 also serves to close the space between the doors 31, 32. In the preferred embodiment of the invention shown, a large number of seal plates 192, one of which is shown in FIG. 29, are pivotally connected end to end by means of pins 193 passing through aligned inner and outer ears 194, 195 projecting perpendicularly from the body 196 of each plate. The pins 193 carry small roller wheels 197 to ride on the rails 173, 174, and the belt-like assembly of interconnected seal plates can roll like a garage door. The seal plate 192 farthest from the transverse cutter 29 is hingedly connected to the upper end of the piston 189 by means 198 best shown in FIG. 28.

Returning to FIG. 27, it can be seen that the track formed by the rails 173, 174, 175 has a curved and then upwardly directed extension 201 formed by rails 202 at the same side of the table 30 as the piston 189. Extending motion of the piston 189 thus pulls the whole row of hingedly connected seal plates 192, with the wheels 197 guided by the rails 202, up the track section 201. The seal plate 192 that is last in line from the top is hingedly secured to the transverse cutter 29 so the cutter follows the plates 192 across the table 30 when the piston 189 is extended. Of course, when the cutter 29 is at the right in FIG. 27, with the doors 31 and 32 closed, the seal plates 192 close the gap between the doors 31 and 32.

If there is ample space, a simple sliding panel can be used in place of the flexible arrangement of plates 192, and a piston and cylinder oriented in the horizontal place can be used in place of the cylinder and piston 187, 189, but the use of the "garage door" arrangement conserves horizontal or "floor" space very effectively.

In one form of the invention employing a different kind of transverse cutter, the "garage door" arrangement is not necessary. This modified embodiment will be discussed hereinafter.

Figure 30:
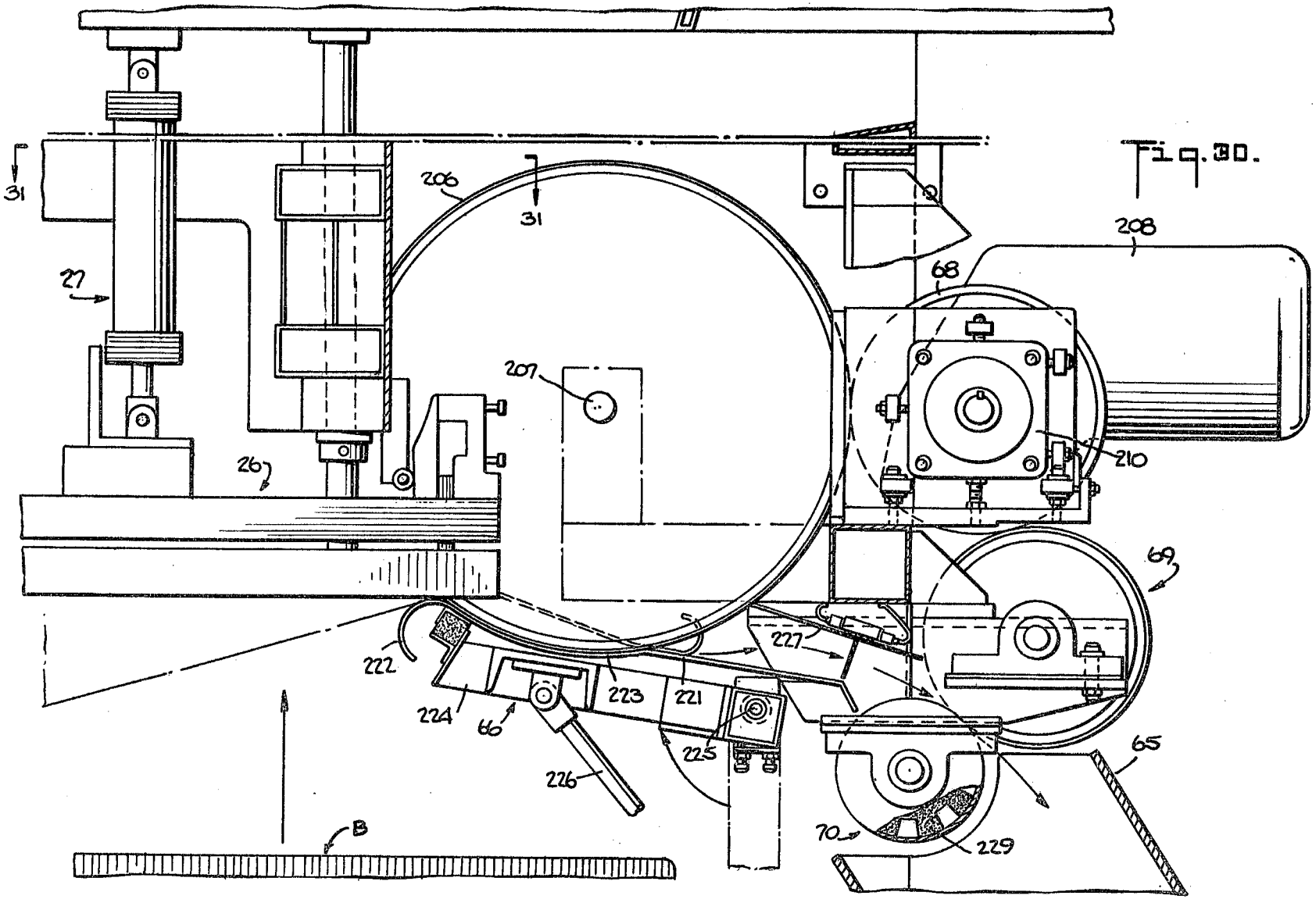
FIG. 30 is a view from the side, partially in section, of an empty bag discharge mechanism of the apparatus of FIG. 1.

FIG. 30 shows the apparatus for lifting a bag and removing empty bags from the area of the cutting table 30. More detailed views in FIGS. 31–35 serve to show the various cooperating parts. The bag lifting head 26 and its elevating piston are shown at the left in FIG. 30, and the opposed empty bag disposal rolls 69, 70 and bag disposal chute 65 earlier referred to with reference to FIG. 16 are seen at the right side of FIG. 30.

Before discussing the bag lifting head 26, the empty bag removal arrangement, which can be effectively used with bag lifting heads of other kinds, should be considered.

Empty bags are removed in a direction substantially perpendicular to the path of travel of full bags through the squaring and cutting apparatus. Comparison of FIG. 30 with FIG. 17 shows that the main drive roller 68 of the bag removal apparatus is in driving contact with a plurality (four shown) of cushioned take out rolls 206 coaxially mounted for rotation with a shaft 207. A motor 208 is located at one end of the drive roller 68 for driving the roller 68. The drive roller 68 is mounted rotatably on the machine frame with conventional bearings 210 at its ends.

Figure 31:
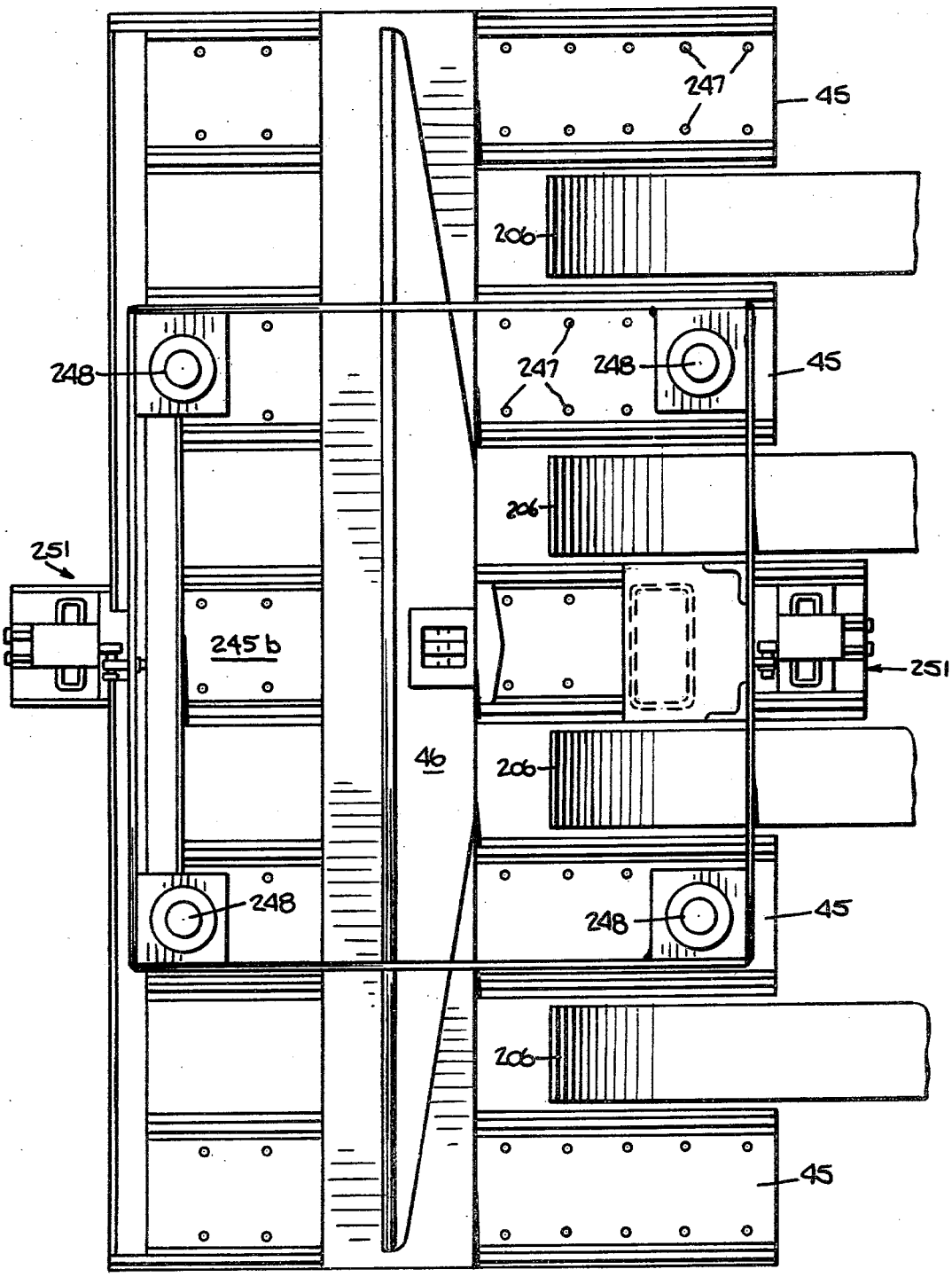
FIG. 31 is a view in section taken along line 31—31 of FIG. 30 and looking in the direction of the arrows.

As shown in FIG. 31, the bag engaging head assembly has a plurality of transverse trough-like modules 45 extending like ribs from a backbone formed by a longitudinal member 46. The modules 45 are so spaced that the takeout rolls 206 fit between adjacent ones of the modules 45 as best seen in FIG. 1 and 31, when the bag lifting head 26 is in elevated position, for engagement of the empty bag.

The bag B is so held that it can be pulled to the right as indicated by the arrows in FIG. 30 by the rolls 206 which contact the bag when the bag is lifted by the head assembly 26 to the position indicated by the dashed lines. The pivotally mounted reaction plate device generally designated by reference numeral 66 cooperates with the rolls 206.

The reaction plate device 66, as shown in FIG. 30, comprises a metal sheet 221 having a downwardly curved lip 222 at its outer edge and a curved central area 223 matching the curvature of the takeout rolls 206 for engaging a bag between the sheet 221 and the rolls 206. The sheet 221 is mounted on a sturdy frame 224 that is pivotally secured at 225 to the machine frame structure. A rod 226 actuated by the piston 67 (shown in FIG. 16) serves to move the reaction plate 66 into position against the rolls 206 when a bag is to be pulled out by the rotation of the rolls 206. An upper guide plate 227 spaced from the sheet 221 defines a passage for the empty bag to a pair of rolls consisting of an upper roll 69 and a lower roll 70, between which rolls 69, 70 the bag is fed to a disposal chute 65. The upper roll 69 of the pair 69, 70 is driven by friction contact with the main drive roller 68 as shown. The lower roll 70 is an idler roll.

To secure a good grip on the empty bags, the rolls 206 and 69 are preferably coated with a somewhat resilient material such as neoprene. The idler roll 70 has, as shown at 229 in FIG. 30, a fluted surface of foam rubber or other soft material to accommodate unevenness of the bags.

The array of rolls 206 on the common shaft 207 is supported from the machine frame structure, as generally indicated by the dashed lines in FIG. 30. Support and guidance for the bag lifting head 26 is provided by means of guide posts 248 attached to the head 26 and shown in greater detail in FIGS. 31–35.

FIGS. 31–35, when considered in conjunction with FIG. 30, show the preferred structure of the bag lifting head 26. The elongated members 45 carry a large number of spaced, downwardly extending spikes 247 at positions shown in FIG. 31 by small circles. Such spikes, some of which are the hollow air spikes shown in earlier figures with the general reference numeral 47, pierce the upper large wall of a bag and support the bag by mechanical engagement when the bag is lifted upon elevation of the head 26.

Figures 32, 35:
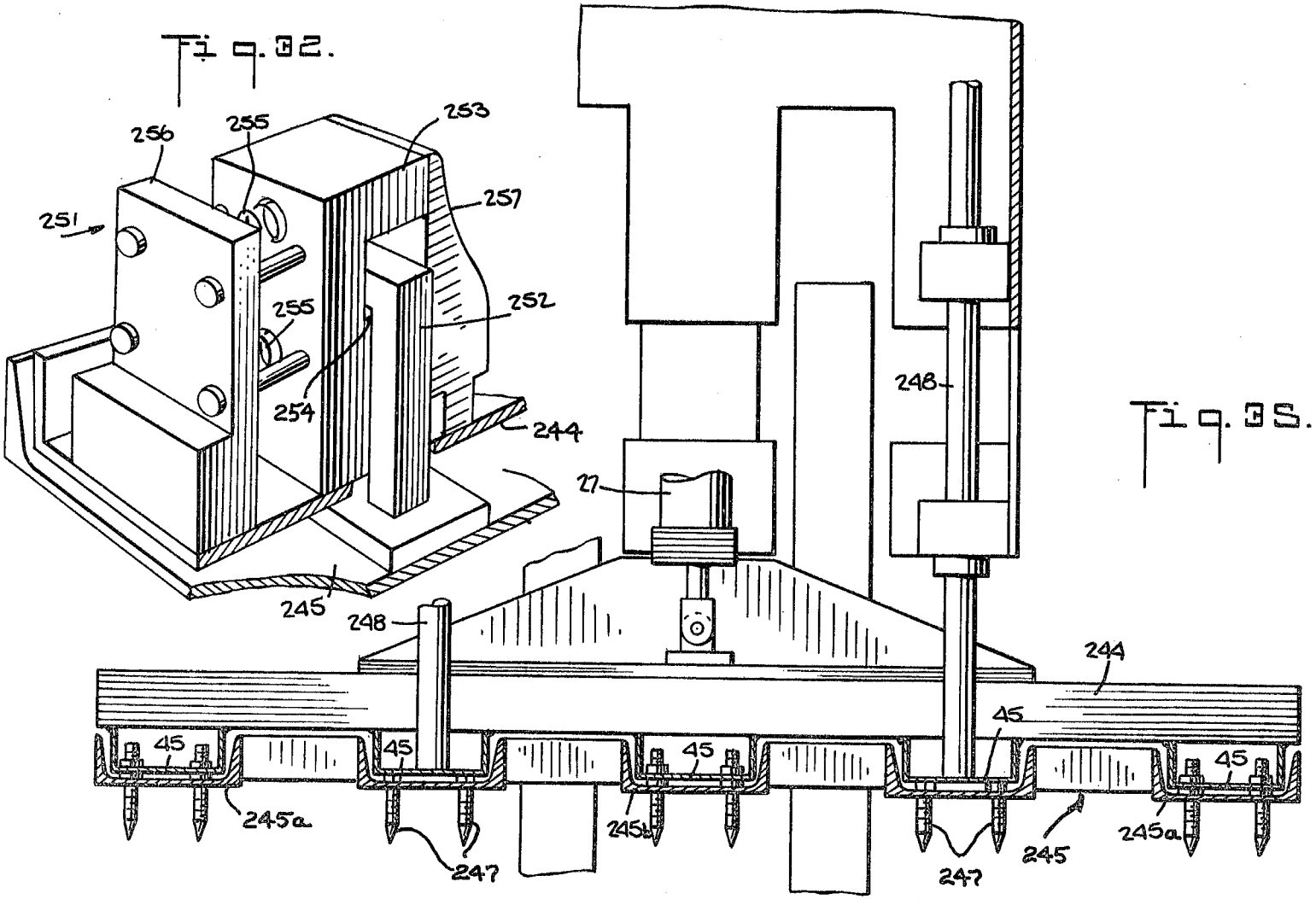
FIG. 32 is a detail view of a locking device of the bag lifting head of the FIG. 1 apparatus.
FIG. 35 is a view in section taken along line 35—35 of FIG. 34 but with the bag not shown for the sake of clarity.
Figures 33, 34:
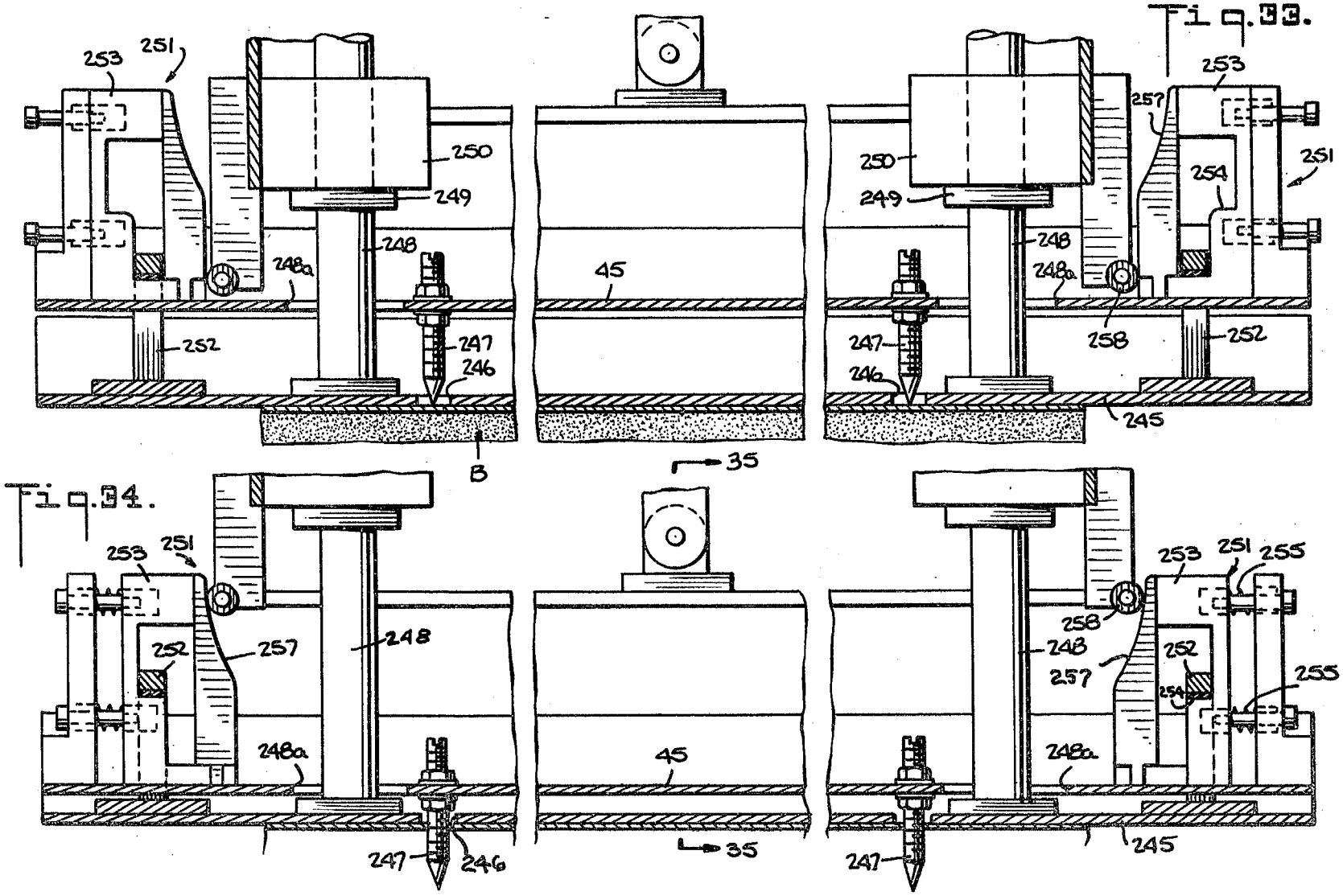
FIG. 33 is an end view in section of the bag lifting head incorporated in the apparatus of FIG. 1.
FIG. 34 is a view similar to that of FIG. 33 but with a bag engaged by spikes of the lifting head.

FIGS. 33–35 show the spikes 247 to be firmly secured to and extending downward from the members 45 of the head 26. The members 45 and their generally horizontal frame structure 244 as shown best in FIG. 35 can be called an upper or "gripping" plate. The spikes 247 can advantageously be roughened, ridged or knurled to enhance engagement with the bag wall.

Beneath the gripping plate assembly 244, and mounted for limited vertical movement with respect thereto is a lower "stripping" plate assembly 245 having channular or trough-like members **245*a* sized to fit around and beneath the trough-like members 45 of the gripping plate 244 as best shown in FIG. 35. Apertures 246 in the members 245 are located below all of the spikes 247, so that when the plates 244 and 245 are brought together as in FIG. 34, the spikes protrude through the apertures 246** to engage a bag as shown.

The condition of the head 26 illustrated in FIG. 34 and 35 is produced when the head 26 has descended on to the top of a bag on the table 30 and obtains until the empty bag is stripped from the head as described hereinafter.

After the crosscut has been made and the doors 31 and 32 are opened, the bag contents are emptied into the hopper H, aided by horizontally directed blasts of air through air spikes 47, which constitute only some of the spikes 247, the others of said spikes serving only as gripping elements.

The head assembly 26 is then lifted, carrying the empty bag upward toward the position at which the bag is to be removed as discussed in conjunction with FIG. 30. To effect this removal, the spikes 247 are withdrawn, that is, the bag is stripped off of the spikes 247.

This stripping is accomplished by limiting the upward movement of the stripping plate 245 while the gripping plate 244 continues to move upward. It has been found that the spikes 247 should enter about 1 to 1½ inches into the bag, so the upper plate 244 is allowed to move correspondingly, and equally about 1 to 1½ inches farther up than the lower plate 245, as shown in FIG. 33.

A stop arrangement limits the extent of upward movement of the stripping plate. As shown in FIGS. 31–35, there are four guide rods 248 passing through fixed guide bushings in a frame attached to the main overhead frame structure. These rods 248 extend upward from the plate 245 through holes **248*a* in the upper plate 244. An adjustable collar 249 on each rod 248 stops further upward motion upon contact with a stop block 250**.

Cooperating with this stop arrangement, there is a latch mechanism 251, shown in detail in FIG. 32, for keeping the plates 244, 245 together during upward movement until the position is reached at which the bag is to be stripped off, and then unlatching to allow the upper plate 244 to move up while the lower plate 245 stays in place. Although some other kind of latch could be employed, a very effective type of latch as shown in the drawing comprises a downwardly directed U-shaped member 252 secured to the lower plate 245 to move within a questionmark-shaped element 253 mounted for horizontal motion on the upper plate 244. The element 253 has a step 254 on which the U-shaped member 252 is received when springs 255 urge the questionmark-shaped element 253 horizontally. The horizontal movement of the element 253 under the action of the springs 255 is controlled by the interaction of a cam surface 257 with a roller 258 mounted on the stop block 250. Comparison of the positions of these elements in FIGS. 33 and 34 illustrates the action of the latch mechanism 251.

When the spikes 247 have been withdrawn at the upper limit of travel of the bag, the previously described bag removal mechanism of FIG. 30 pulls the empty bag away for disposal.

The construction and function of the side squaring guides 50 has been discussed with reference to FIGS. 18 and 19 and 22 and 23. The squaring guides 50 are mounted for inward and outward movement with the carriages 141 of the longitudinal cutters 28. On the opposite side of the cutters 28 from the squaring guides 50, there are provided cutting table squaring guides 260 which are also secured to the cutter carriages 141 for inward and outward movement therewith and which extend as parallel continuations of the guides 50. FIG. 36 illustrates one of the squaring guides 260 secured by bolts 261 to the carriage 141 (which is not fully shown in FIG. 36). The squaring guide 260 shown in FIG. 36 houses a back stop sensing mechanism 55 shown in FIGS. 36–41. The other cutting table squaring guide 260, which is not illustrated in detail, can be a hollow rail without internal working parts, since its primary functions are to restrain the bag B during the transverse cutting operation to assure optimum alignment of the back during the cross cutting and to minimize spillage from the longitudinal cuts until the transverse cut is completed.

The back stop sensing device generally designated 55 serves to indicate that a bag B is centered with respect to the transverse cutter 29 so that the cross cut will be made at the middle of the bag.

The sensor arrangement of FIGS. 36–41 enables the apparatus to handle bags of varying sizes by assuring that each bag advances to a centered position. For this purpose a paddle-like plate 262 is mounted to be pushed by the leading end of the bag while a spring switch 286 is held depressed by the side of the bag. As the plate 262 is pushed forward, the spring switch 286 moves backward in the opposite direction until it passes the following end of the bag and is thereby released, whereupon the bag is indicated to be in centered position.

Figures 38, 38A, 39, 40:
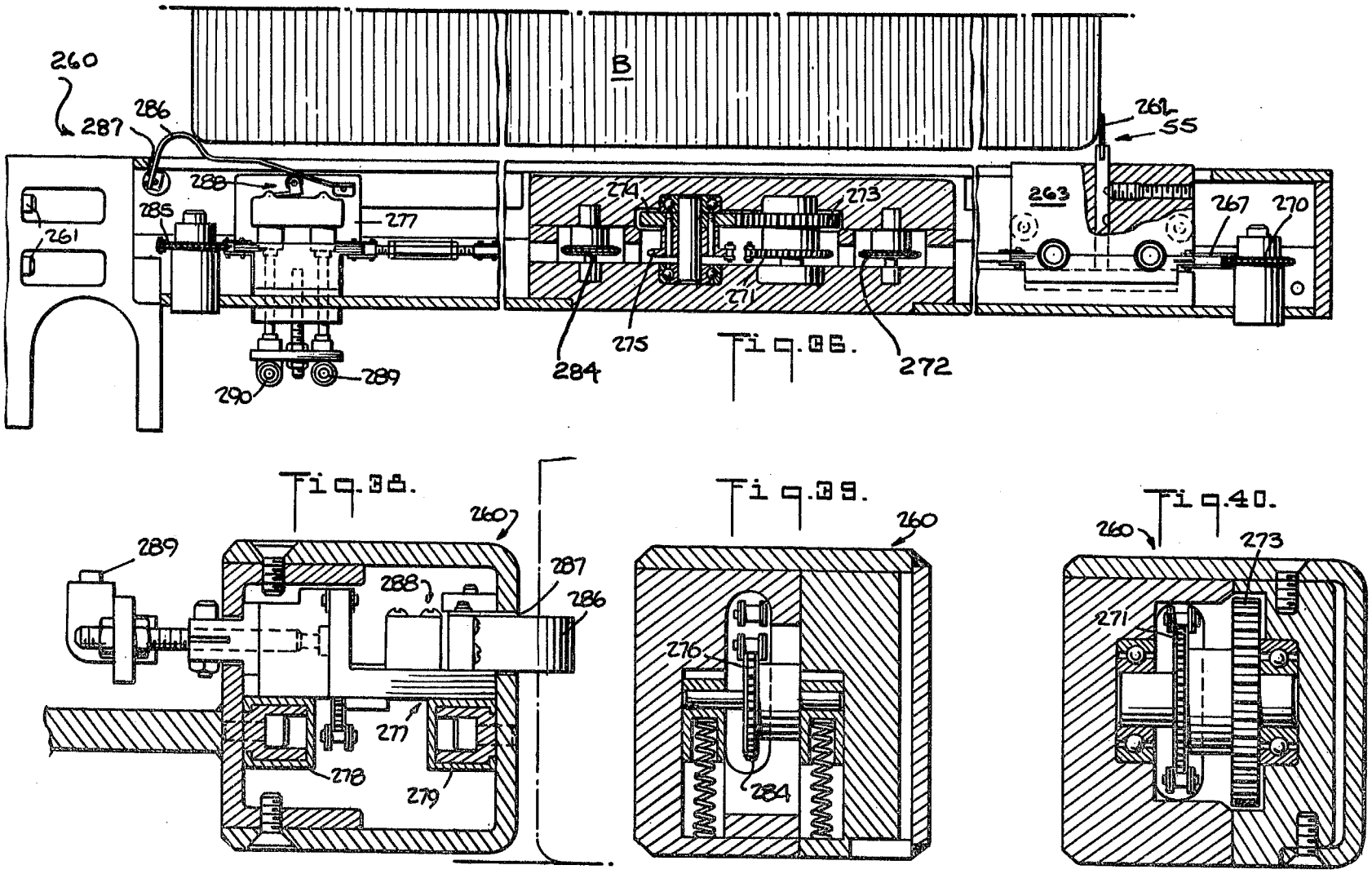
FIG. 38 is a view in section taken along line 38—38 of FIG. 37 and looking in the direction of the arrows.
FIG. 39 is a view in section taken along line 39—39 of FIG. 37 and looking in the direction of the arrows.
FIG. 40 is a view in section taken along line 40—40 of FIG. 37 and looking in the direction of the arrows.
Figures 37, 41:
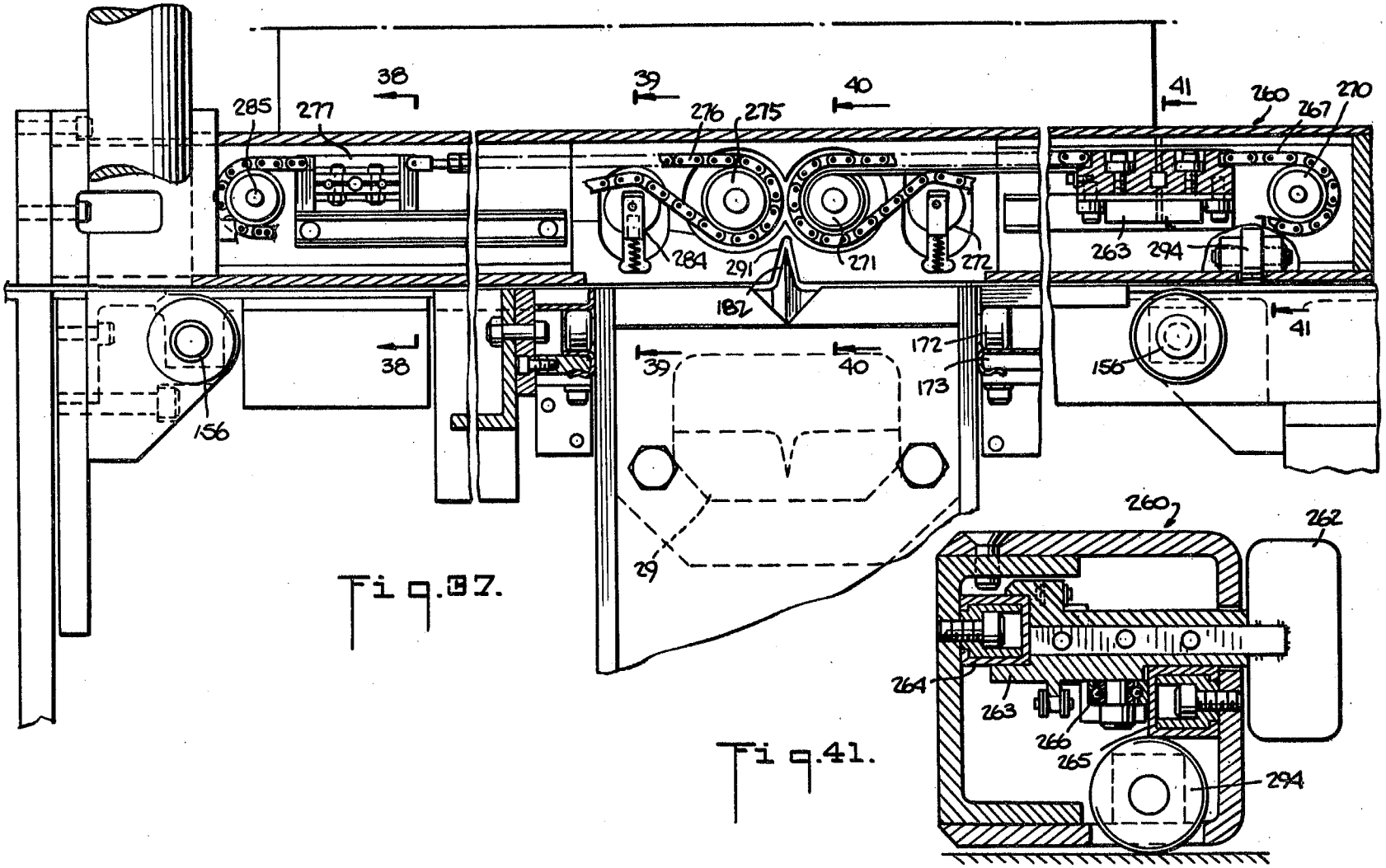
FIG. 37 is a side view, with parts removed for clarity, of the end-stop sensing mechanism of FIG. 36.
FIG. 41 is a view in section taken along lines 41—41 of FIG. 37 and looking in the direction of the arrows.
Figure 41:
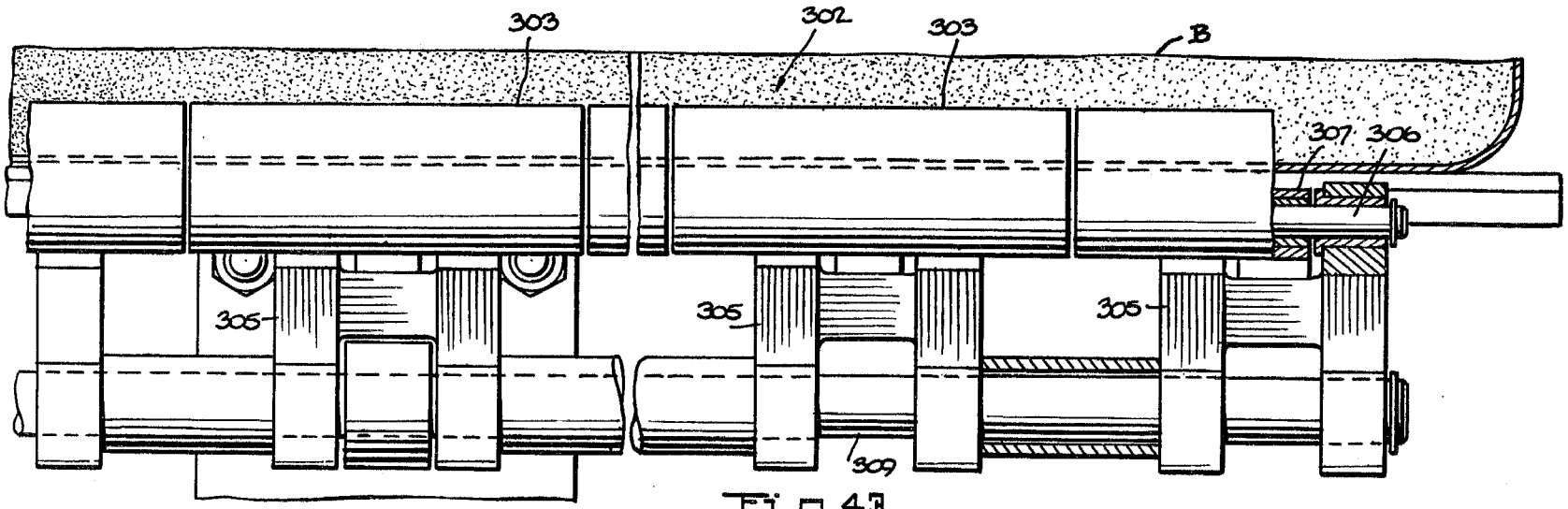

A bag is shown in centered position in FIG. 36, wherein it can be seen that the plate 262 extends inwardly from the guide 260. The plate 262 is mounted on a carriage 263 arranged to roll forward or back along rails 264, 265 secured lengthwise within the squaring guide 260. FIG. 41 shows one of the bearings 266 on the carriage 263 for rolling motion along the rail 265. The carriage 263 is secured to both ends of a roller chain 267, and this roller chain passes over sprockets 270 and 271 as shown in FIGS. 36, 37 and 40. The sprockets 270 and 271 are journalled to roll freely as the roller chain 267 is pulled along by the carriage 263. A spring biased intermediate sprocket 272 is employed to keep the roller chain 267 tight. As shown in FIG. 40 the sprocket 271 is mounted coaxially with a gear 273 which rotates with the sprocket 271. The teeth of gear 273 mesh with the teeth of a similar gear 274 carried on the same shaft as a sprocket 275 which is engaged by a roller chain 276. The roller chain 276 is similar to the chain 267. The roller chain 276 has both of its ends secured to a carriage 277 mounted for reciprocating motion on rails 278, 279 as shown in FIG. 38. A spring biased chain tensioning sprocket 284, as shown in FIG. 32, similar to sprocket 272, is provided between the sprocket 275 and a further sprocket 285 over which the chain 276 passes. The carriage 277 is thus arranged to move in response to the movement of the plate 262 and carriage 263, but always in the opposite direction.

The carriage 277 carries the spring switch 286 which extends through a slot 287 in the squaring guide 260 towards the bag B. When the carriage 277 has moved back to the position shown in FIG. 36, the switch 286 is no longer held inside the guide 260 by the bag, but can pop out at the rear of the bag and open a relay generally designated 288, which, as shown in FIGS. 36 and 38, controls the flow of air through conduits 289, 290. This air flow actuates the gripping head 26 to lower and engage the bag. The same effect could be achieved with this mechanism by employing electrical signals rather than air pressure at the relay switch 288.

FIG. 37 shows how the squaring guide 260 is related to the other parts of the mechanism at the bag cutting area. It will be seen that a V-shaped notch 291 is provided to permit passage of the cutting wheel 169. Notches, no shown, are also provided in the tops of the squaring guides to clear the rows of spikes 247 of the lifting head 26. The hinges 156 of the doors 31 and 32 and the roller wheels 172 and 173 are also seen in FIG. 37. It will be noted that a roller wheel 294 is provided at the end of the squaring guide 260 for support as the guide 260 moves in and out.

In applications where the exact position of a bag on the table 30 is not critical, or where all bags to be cut are the same size, the sensing mechanism of FIGS. 36–42 can be replaced by a simpler and more economical, yet effective, device as shown in FIG. 7. This simpler mechanism consists of a trigger finger switch 55 mounted on the door 32 at the position which is to be the limit of forward travel of the front end of the bag. Depression of the switch 55 by the bag end can actuate the other devices as indicated above. The switch 55 could be adjustable to forward or rear positions for handling runs of bags of different sizes.

It has been found that cutting bags open by a combination of heat and pressure, whether by means of freely rotating hot cutting wheels or a dull heated blade avoids the difficulties encountered when driven circular cutters are used to cut bag walls. But in certain applications of the invention, the longitudinal cutters 28 and transverse cutter 29 can advantageously be replaced by the self-sharpening scissor type cutter 295 of FIG. 44. The cutter 295 takes advantage of the relative motion of the bag as the bag is thrust forward. The same mounting arrangement, i.e. a 45° angle with respect to the bag's lower side edges, can be used for the cutter 295, and cutters 295 can be positioned at the same location as the longitudinal rotary wheels 28 heretofore described. The cutter 295 has a generally horizontally extending spike 296 with a bag piercing point 297 for impaling the bag as the bag moves forward. This spike 296 is held stationary while a blade 298, hinged to the spike 296 at 299, is rapidly actuated toward and away from the spike 296 by means of a pneumatically or hydraulically actuated piston and cylinder assembly 300, or alternatively, by a suitable electric motion and cam drive. As shown in FIG. 44, both the spike 296 and the moving blade 298 have sharp edges for cutting the bag wall therebetween. In this embodiment, the cutter 295 is not heated. A similar mechanism for scissor type transverse cutting can be substituted for the roller cutter 29.

Figure 42:
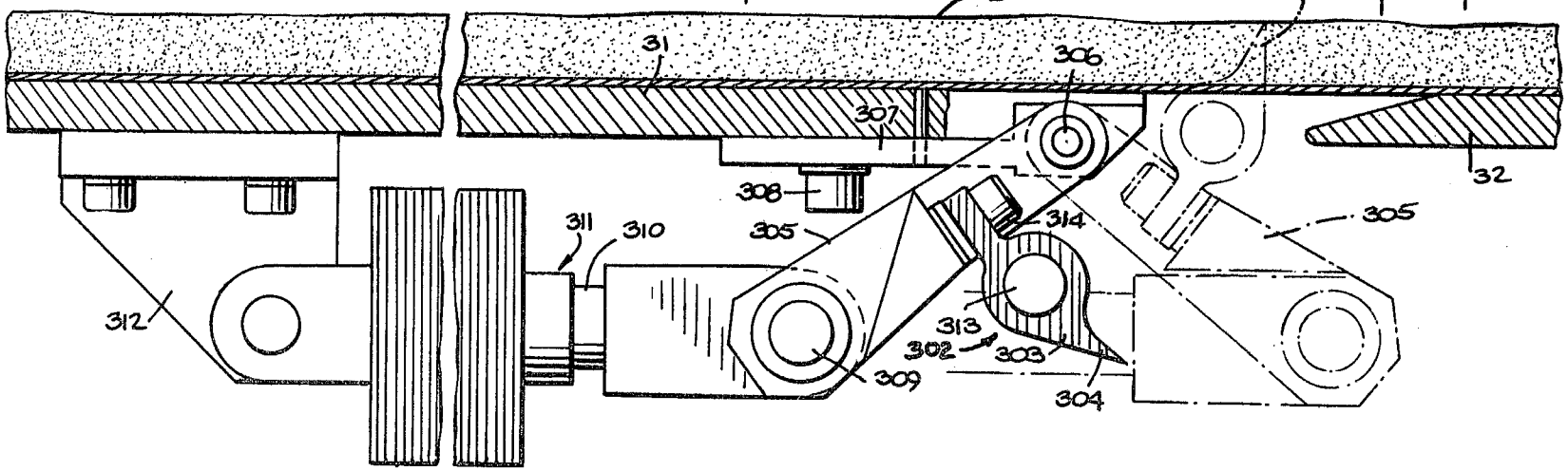
FIG. 42 is a side view, with portions broken away, of a transverse bag cutting device according to the invention, showing the operative portion of a blade in dashed lines.

A modified form of transverse bag cutter is shown in FIGS. 42 and 43. Since the cutter shown in FIGS. 42 and 43 is simpler and less expensive than the rotary cutter 29 that has been described, this embodiment is preferable in most applications. This simpler cutting arrangement eliminates the need for the "garage door" mechanism shown in FIGS. 27–29, but in most other structural respects the apparatus is as described above. When the cutter of FIGS. 42 and 43 is employed there is no need for engagement of the bag at its sides by the squaring guides during cutting, so these guides can move outwardly before transverse cutting with the simpler embodiment.

In the embodiment of FIGS. 42 and 43 a pivotably mounted blade 302 comprising a plurality of blade segments 302 is hinged beneath the door 31 so that the cutting edges 304 of the blade segments 303 can be rotated through the space between the doors 31 and 32 to engage and cut the bag by a combination of heat and pressure at the temperature stated above for the rotary cutters.

The segmented structure of the blade 302 as best shown in FIG. 43 allows for thermal expansion and for self-alignment of the blade segments 303, each of the blade segments being mounted by means of a single retaining screw 314. A plurality of lever arms 305, one for each blade segment 303, are pivotally secured at one end to an elongated rod 306 carried by mounting members 307. The members 307 are secured beneath the leading edge of the door 31 as shown at 308 in FIG. 42.

At the opposite ends from the rod 306 the lever arms 305 are secured to a rod 309 extending parallel to the rod 306. The rod 309 is mounted on a piston 310 housed in a cylinder 311 and the cylinder 311 is pivotally secured at its rear end to a bracket 312 carried by the door 31. Upon actuation of the piston 310 to forward movement, the blade 302 moves from the retracted position shown in solid lines in FIG. 42 to the extended, cutting position shown in dashed lines in that figure.

The blade segments 303 are heated by an elongated rodlike heat cartridge 313 that extends through aligned holes in the segments 303. The straight blade edge 304 gives a rapid, clean cut through the tense, flat bottom of the bag. Backup force for the transverse cut is provided by a long crossmember at 245*b* in FIG. 31 extending across the lifting head stripping frame.

The most effective temperature for heated blades as described, whether the blades be rotary or straight, has been found to be about 850 to 900 degrees. The blade members may be of some good heat conducting material such as nickel or a nickel alloy, and blade cutting edges are preferably chrome coated or plated. To minimize heat loss, particularly radiant, through surfaces of the blade members other than the edges, it has been found that a coating of the refractory material zirconia should be applied to such surfaces. Similar material, like alumina which also has excellent characteristics of low radiant heat emission, can be used.

FIGS. 45–59 illustrate a presently preferred apparatus in accordance with the invention, the apparatus being generally indicated by reference numeral 410. In FIG. 45 and other subsequent figures the bags or sacks, to be opened in the apparatus 410 are indicated by reference character S. The bags or sacks S are shown in three positions during the handling process through the apparatus, these positions being indicated at S1, S2 and S3, respectively.

Generally describing the bag opening procedure at position S1 the bag is positioned on a conveyor 415 for movement into the apparatus 410. At position S2 the bag is inside the apparatus, having entered through an entrance opening 412a, in the totally enclosed and dust-proof panelled enclosure (not shown), and is temporarily in a stationary position waiting to be opened and emptied, the conveyor 415 being stopped at the time. Further movement of the conveyor deposits the bag at position S3 on a horizontal table 416 ready to be shaken or vibrated to settle its contents, during or after which it will be centered on the table 416 and opened by cutting along three of its underside corner edges to form a U-shaped flap by which it will be emptied. The bag is first centered longitudinally on the table 416 and cut transversely across its forward and rearward ends, and is thereafter centered transversely and cut longitudinally along one side, and perforated longitudinally to form a perforated hinge line along its other side. Preferably, the shaking action of the vibrator table 416 continues during the centering and cutting steps, after which the shaking action is terminated and the bag contents emptied as will be described. After emptying, the bag S will be automatically removed from its position at S3 and discharged from the apparatus 410 whereupon the conveyor 415 is again actuated to deposit the next full bag at position S3 on the table 416.

Referring to FIGS. 45 and 46, the apparatus 410 includes an overhead horizontal frame structure 411, four corner-located vertical members 412, and a lower horizontal frame structure 413, which are joined together to define an enclosure frame within which the various bag processing mechanisms of the apparatus will function. This surrounding frame structure lends itself to dust-proof enclosure of the apparatus, as by attached panelling (not shown), to isolate the mechanisms and the bag being opened from the environment, thus providing an enclosed bag-opening system. This frame enclosure is supported by four corner-located supporting posts 414. Of course, the structural frame construction shown in FIG. 45 is merely illustrative, and might be differently arranged to suit particular spacial or other requirements.

With reference to FIG. 45 it will be understood that the bags S enter the apparatus from the left hand side on the belt conveyor 415, only the discharge end of which is shown. The conveyor 415 automatically and sequentially advances and stops, moving successive bags from position S1 to position S2, and thence from position S2 to position S3 on the table 416. When a bag is in position S3, a plurality of vibrators 417, of a conventional type, vibrate the bag cutting table 416 to cause the granular or powdery material within the bag S to settle into the lower volume and recesses of the bag, thus assuring back up for the cutting action of the apparatus, as will be described.

Located at either end of the table 416 are respective and oppositely disposed air cylinders 418a and 418b which are operated simultaneously to move their respective driven members or piston rods 419a and 419b forwardly at the same rate to center the bag beneath the gripping and clamping head 421 of the apparatus. During this centering operation, the bag S is actually contacted and pushed into position by the respective heated cutter blades 420a and 420b mounted on the respective piston 419a, 419b.

As the centering of the bag at position S3 is being completed the gripping and clamping head 421, in its "clamping mode" by reason of its clamping plate 422 being in its extended or depending position relative to the stationary plate element 422a of the clamping head, is moved downwardly by the piston rod 424 of a vertical air cylinder 423 located thereabove. Upon contact by the clamping plate 422, the bag is clamped in its position S3 on to the table 416, thus holding the bag against buckling or arching as might occur as the heated cutter blades 420a and 420b continue to be forced against the bag to make respective transverse cuts extending across the bag near its lower edge at each end.

The movement of the clamping and stationary plate elements 422, 422a of the gripping and clamping head 421 is guided by a pair of telescoping guides 425 which are respectively aligned with but spaced away in longitudinal direction from the air cylinder 423 at either side thereof as shown in FIG. 45. These telescoping guides prevent the plate elements 422, 422a, and the piston rod 424 on which the stationary plate 422a is mounted, from pivoting with respect to the air cylinder 423, as might otherwise occur during operation.

When cutting of the forward and rearward bag ends is completed, the heated cutter blades 420a, 420b are retracted by retraction movement of the respective air cylinders 418a, 418b, and the clamping plate 422 is then lifted off the bag by retraction movement of the vertical air cylinder 423. As the clamping and stationary plate elements 422, 422a arrive at their retracted positions, the clamping plate 422 moves upwardly relative to the stationary plate 422a to expose the gripping spikes 426 below the clamping plate 422 as will be described, and to thus convert the head 421 from its aforementioned "clamping mode" to its "gripping mode".

Figure 49:
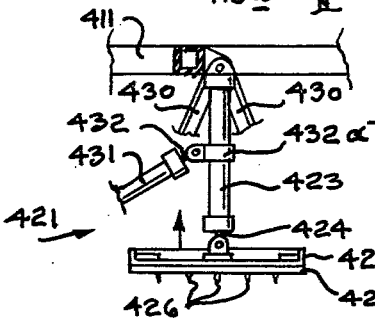

For this purpose, the clamping plate 422 is moved vertically relative to the stationary plate 422a by a pair of small air cylinders 428 mounted on the stationary plate 422a and whose respective movable piston rods 429 extend through appropriate apertures (not numbered) in the plate 422a and are attached to the clamping plate 422. The clamping plate 422 is also appropriately apertured to permit downward extension of each of the plurality of gripping spikes 426 therethrough, the length of the spikes 426 being greater than the thickness of the clamping plate 422 so that they will pierce and extend about one inch or so into, and thus grip a bag positioned on the table 416 therebelow. The "gripping mode" of the gripping and clamping head 421 is illustrated in FIG. 49. Thus, when the air cylinders 428 are actuated to retract their respective piston rods 429, the spikes 426 are exposed below the gripping plate 422, and when the air cylinders 428 are actuated to extend their pistons 429 the clamping plate 422 is positioned and firmly held at an elevation below the pointed ends of the spikes 426 so that it will function as a flat surface gripping plate. It will also be noted that the movement of the plate 422 from its retracted position to its extended position provides a "stripping" action by which a bag may be removed from the spikes 426.

Figure 50:
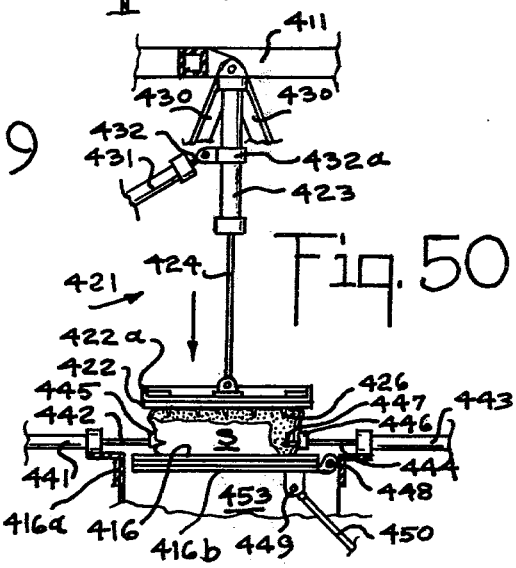

Continuing with a description of the bag cutting and opening operation, and referring to FIG. 50, a longitudinal heated cutter blade 445, for forming a longitudinal cut extending between the previously described transverse cuts at the forward and rearward end edges of the bag S, is carried by the piston 442 of a transversely oriented air cylinder 441 which is mounted on a stationary angle-iron frame 416a. The frame 416a surrounds the vibrating table 416 as will be understood from a comparison of FIG. 50 with FIG. 48, and also mounts the longitudinally extending cylinders 418*a*, 418*b*. On the opposite side of the vibrating table 416 a transversely extending air cylinder 443 is similarly mounted on the surrounding table frame 416*a*, its extensible piston rod 444 carrying a longitudinally extending perforator bar 446. As illustrated in detail in FIG. 58, the perforator bar 446 carries an aligned and spaced apart plurality of laterally projecting pointed spikes 447 which will perforate the bag S to form a perforated hinge line along the longitudinal edge of the bag which is opposite the aforementioned longitudinal line of cut, thus to complete the forming of a U-shaped flap at the bottom of the bag during the cutting operation.

Referring again to FIG. 50 which shows the apparatus as its appears during the forming of the referred to longitudinal cut and oppositely disposed perforated hinge line, the air cylinders 441 and 443 are actuated simultaneously to extend their respective piston rods 442 and 444 toward each other at the same rate so that the longitudinal cutter 445 and perforator bar 446 contact and first center the bag S in the transverse direction. Promptly as the bag is centered, the gripping head 421, now in its gripping mode, is lowered so that the gripping spikes 426 perforate the upper wall of the bag as seen in FIG. 50, and the heated longitudinal cutter 445 and the unheated perforator bar 446 continue their inward movement to respectively cut and perforate the opposite sides of the bag, thus to form the U-shaped flap at the underside of the bag. Contact of the clamping plate 422 against the upper wall of the bag prevents buckling or arching of the bag as the longitudinal cutting and hinge-forming perforating operations are performed. With the head 421 remaining in its downward position as shown in FIG. 50, the longitudinal cutter 445 and perforator 426 are retracted by actuating the respective air cylinders 441 and 443, and the vibrator 417 is deactivated at this time. The thus cut and opened bag S is now ready to be emptied.

FIG. 47 diagramatically shows the underside of the bag S after it has been cut as aforesaid in a U-shaped pattern of cut along cut lines 437, 438 and 438*a*, and having its fourth side perforated, as at 440, to form a hinge line. The filled bag itself has the general form of a paralelepiped of somewhat rounded contours with a generally rectangular lower face or wall 436. Industrial and commercial bags of this type used for packaging bulk goods generally range in size from 3"×14"×20" to about 12"×28"×48" and the various parts of the apparatus described are suitable proportioned to accommodate bags having this range of size although, of course, the apparatus could have greater or smaller dimensions for particular applications. The actual plane of the lines of cut 437, 438 and 438*a* and perforation 440 is about 1" to 1½" above the plane of the bottom wall 436 so that there will be no "shelf" structure remaining on the main body of the bag as might otherwise be formed by inwardly turned edges at its underside and as would hold material to prevent its fall by gravity from the bag after the bottom wall 436 is cut. The cut bag is opened by dropping the flap 436 in the direction of the arrows to the dotted line position indicated at 439 in FIG. 47.

The manner in which the thus cut and opened bag S is emptied of its contents and thereafter removed from the apparatus 10 will now be described with reference to FIGS. 51–54 and FIG. 46.

As seen in FIG. 46 the gripping and clamping head 421 has an "A-frame" appearance formed by diagonal structural members 430 at either end thereof which are joined together to form an apex by which the head is pivotally mounted at its upper end. The pairs of diagonal members 430 are in spaced apart relation at their lower ends. As seen in FIG. 45, the respective A-frames formed by members 430 lie within the same plane as the respective telescoping guide rods 425.

As will be understood from FIG. 46, the gripping and clamping head 421 is mounted for pivotal movement on a longitudinally extending pivot rod 421*a* mounted on the upper frame 411. The head 421 is maintained in its upright position as shown in full lines in FIG. 46 by the retracted lateral air cylinder 431 whose piston rod 432 is pivotably connected to a collar 432*a* on the vertical air cylinder 423, as shown. The opposite end of the air cylinder 431 is pivotably connected to a fixed structural member 433 of the apparatus. When the air cylinder 431 is actuated to extend its piston rod 432, it is seen from the dotted line showing in FIG. 46 that the gripping and clamping head 421 will be pivoted in counterclockwise direction to bring its gripping and stationary plate elements 422, 422*a* to a position above a fixed, empty bag discharge chute 434. A flexible baffle 435, mounted on the top of the discharge chute 434 as shown, guides each empty bag on to the discharge chute as it is stripped from the gripping head 421 in manner to be described.

Figure 51:
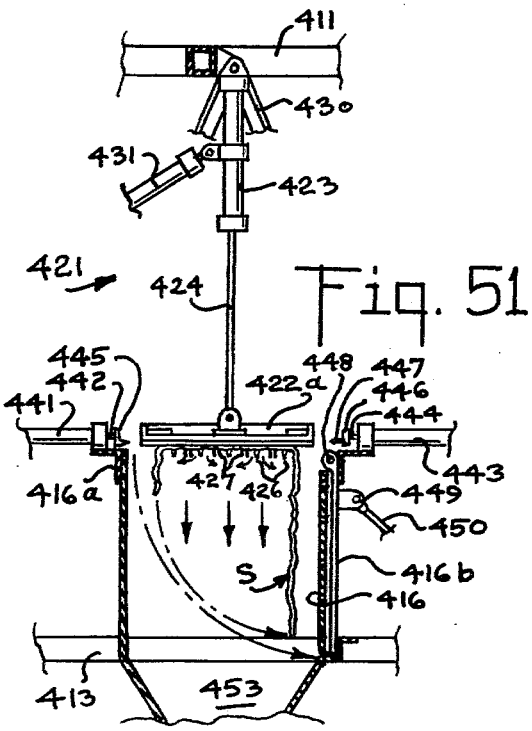

FIG. 46 also shows the hinged mounting of the vibrator table 416, by which each opened bag is emptied of its contents. The vibrator table unit actually comprises the vibrator table 416, vibrators 417 and a hinged table element 416*b*, only the latter being hinged along the longitudinal hinge 448 to pivot from its horizontal position shown in FIG. 46 to the vertical, or bag-emptying position of the table as shown in FIG. 51. The movement is effected by an air cylinder 451 whose movable piston rod 450 is pivotably connected, as at 449, to the underside of the hinged table element 416*b*. The opposite end of the air cylinder 451 is pivotably connected, as at 451*a*, to a fixed frame element 452 of the apparatus 410. In FIG. 46 the piston rod 450 is shown in its extended position, by which the vibrating table 416 is retained in its horizontal position. Actuation of the air cylinder 451 to retract the rod 450 causes the table to drop to its vertical position as shown in FIG. 51.

Returning now to a description of the manner in which the open bag S is emptied and removed from the apparatus 410, reference is first made to FIG. 51 which shows the longitudinal cutter 445 and longitudinal perforator bar 446 in their retracted positions after the previously described longitudinal cutting and perforating operations. The upper wall of the bag S is retained by the gripping spikes 426 against the gripping head 421, the pointed spikes 426 having roughened, knurled or threaded outer cylindrical surfaces to frictionally grip the jagged edges of the pierced bag wall at each spike. Of course, the transverse cutters 420*a* 420*b* are also in their retracted positions.

Air cylinder 451 (FIG. 46) is actuated to retract its piston rod 450, thus dropping the vibrator table 416 to the position shown in FIG. 51, whereupon the bag contents (not shown) drop by gravity into the product discharge chute 453 which is directly below the table frame 416*a*. Simultaneously, the vertical air cylinder 423 is actuated to move the gripping head 421 further in the downward direction until its gripping plate 422 lies essentially within, or slightly above, the plane formerly occupied by the top surface of the vibrating table 416 when in its horizontal position as shown in FIG. 46. Of course, as shown in FIG. 51, as the contents of the bag S fall by gravity, the bag flap 436 formed by cutting as previously described, swings downwardly following the similar movement of the table 416, free movement of the flap being facilitated by the perforated hing line 440 (FIG. 47). Thus, the bag contents are emptied completely and rapidly into the product discharge chute 453. Discharge of the contents from the bag is also aided by compressed air which is momentarily supplied to selectively located hollow air spikes 427 (FIG. 51) which are also mounted on the stationary plate 422*a* and project through appropriate apertures in the clamping plate 422. Such air burst fills the void being created by the emptying of the contents of the bag thus eliminating any forming of vacuum as might cause "hang up" of the discharging material. The air also removes wrinkles and purges the bag of its contents, and is discontinued as soon as emptying of the bag has been completed.

Figure 52:
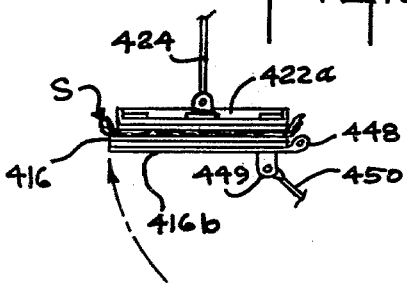

After emptying the bag S has been completed, the air cylinder 451 (FIG. 46) is actuated to extend its piston rod 450, thereby causing the vibrator table 416 to swing upward to its horizontal position as seen in FIG. 52. Such movement of the table 416 carries with it the emptied bag flap 436 (FIG. 51), and it will be noted that the flap 436 can be forced on to the gripping spikes 426 of the rod 421 as the flap is sandwiched between the top surface of the table 416 and the bottom surface of the clamping plate 422 which has remained in the position shown in FIG. 51. The table 416 is provided with properly located comating holes or slots (FIG. 51) to clear the spikes 426 and compressed air nozzles 427 during the referred to impaling of the bag flap 436 and the concurrent bag-flattening action as seen in FIG. 52.

FIG. 53 shows that all of the empty bag S, including its underside flap 436, is impaled on the gripping spikes 426 after the gripping and clamping head 421 has been retracted from its position as shown in FIG. 51 to its start position as shown in FIG. 53 by actuating the cylinder 423 to raise its piston rod 424. The flattened empty bag is now ready for discharge from the apparatus.

FIG. 54 shows the gripping and clamping head 421 rotated approximately 65° in the counterclockwise direction, which is caused upon actuation of the air cylinder 431 to extend its piston rod 432, to which the head 421 is connected. As the head 421 carries the bag S to the position shown in FIG. 54 it deflects the flexible rubber or plastic baffle 435, which thereupon springs back into its vertical condition as shown. This action of the baffle 435 prevents the empty bag S from falling back into the region of the table 416, and also guides the flattened empty bag S on to the discharge chute 434. The bag is stipped from the gripping spikes 426 by movement of the clamping plate 422 away from the stationary plate 422*a* by actuation of cylinders 428 and the consequent extending movement of their piston rods 429 (see FIGS. 45 and 48). The bag S discharges from the apparatus by gravity along the chute 434, and is thereupon collected with other empty bags for later compacting and disposal. The gripping and clamping head 421 is then pivoted from its position as shown in FIG. 54 back to its upright position as shown in FIG. 46 by retraction movement of air cylinder 431. It should be noted that the opening of a succeeding bag can be initiated as soon as the previous empty bag S has been fully raised by the head 421 from the table 416 to the position shown in FIG. 53. This permits overlapping of operating cycles, thus increasing the handling capacity of the apparatus 410.

FIG. 55 illustrates in perspective the preferred construction of any of the heated cutter blades 420*a*, 420*b* or 445. The straight blade is formed by a plurality of blade segments 454, an electric heater cartridge 456 being passed through all of the laterally aligned blade segments as indicated. The blade segments 454 are respectively attached to a support bar 457 which, in turn, is mounted on the end of one of the air cylinder piston rods 419*a*, 419*b* or 442.

FIG. 56 shows a modified form of cutter blade in which the blade segments 455 have scalloped cutting edge configuration as shown, rather than straight configuration as are the blade segments 454 shown in FIG. 55. The use of such scalloped blade segments 455 are preferred where unusually stiff or wrinkled heavy walled bags require initial local penetration by the points 461 of the scalloped blade edge to weaken the bag material for the subsequent cutting action of the middle length of the blade.

FIG. 57 is an enlarged cross-sectional showing of the cutter blade shown in FIG. 55, and shows that the air cylinder piston rod 419*a*, 419*b* or 442 is conveniently attached to the cutter blade support bar 457 by a threaded connection 458 and a locking nut 458*a*. The individual cutter blade segments 454 (or 455) are each retained on the lower edge of the support bar 457 by a single shoulder screw 460, the mounting aperture 460*a* of each blade segment being of larger diameter than the screw 460 to permit self-alignment of the blade segment as thermal expansion takes place when the blade is heated by the heater element 456. A heat resistant gasket 462 of asbestos or like material insulates the support bar 457 from direct contact with the hot blade segments 454 (or 455).

In FIG. 59, a typical assembly of the perforator bar 446 of FIG. 58 is shown. Each perforator spike 447 is threadedly attached as by threaded connection 447*a* to a support bar 446 adjacent to the lower edge thereof. The support bar 446 is threadedly attached, as at 458, to the piston rod 444, and a lock nut 459 secures the connection.

Of course, actuation of the infeed belt conveyor 415, and of each of the various air cylinders described is controlled by conventional mechanisms and air logic circuits as will be apparent to those skilled in the art and which therefore need not be described.

Although certain preferred embodiments of the bag opening method and apparatus of the invention have been described in detail, it is obvious that numerous adaptations, modifications, substitutions of parts and materials will suggest themselves to those familiar with the art, and such variations are considered to be within the spirit and scope of the invention.

What is claimed is:

1. A bag opening and emptying machine comprising table means for receiving a full bag to be opened and emptied, squaring means for rendering side and end walls of said bag substantially perpendicular to a lower bag wall when on said table means, cutting means having means for heating the same for cutting a bag by a combination of heat and pressure, said cutting means being mounted adjacent to said table means, means providing relative movement between said bag and said cutting means whereby at least one of said bag walls is contacted and pressed momentarily by said heated cutting means for producing a line of cut through the bag wall, and means for emptying said bag.

2. The machine of claim 1 wherein said cutting means includes a plurality of cutting means arranged with respect to each other to form a substantially U-shaped continuous line of cut having a pair of end termini providing a foldable flap of said bag when cut, and which further comprises hinge-forming means for producing a line of fold extending between said end termini of said lines of cut and along which said flap is foldable.

3. The machine of claim 2 wherein said hinge-forming means comprises a perforator bar having a plurality of spikes for piercing a wall of said bag, said perforator bar being mounted for movement whereby its said spikes will pierce said bag wall.

4. The machine of claim 1 wherein said squaring means comprises means for vibrating said table means.

5. The machine of claim 1 which further comprises bag holding means comprising a clamping and gripping head mounted for movement above said table means for engaging an upper wall of said bag on said table means, said clamping and gripping head carrying a plurality of downwardly facing spikes for piercing an upper bag wall to mechanically engage and hold said bag thereon.

6. The machine of claim 5 wherein some of said spikes are air nozzles, and which further comprises means for blowing air through said nozzles.

7. The machine of claim 1 which further comprises means for holding said bag, means for moving said table means away from said lower bag wall after said cutting and while said bag is held to permit gravity discharge of bag contents, said moving means comprising hinge means permitting pivotal movement of said table means, and means for holding said table means in a horizontal position and for pivoting said table means downwardly on said hinge means.

8. The machine of claim 1 wherein said squaring means comprises means for pressing against an upper wall and said side and end walls of a bag on said table means, and vibrating means for settling bag contents during squaring.

9. The machine of claim 1 wherein said cutting means comprises a pair of transversely spaced apart longitudinal cutters mounted substantially adjacent to a pair of opposite edges of said table means, and at least one transverse cutter for cutting across said lower bag wall between the lines of cut formed by said longitudinal cutters.

10. The machine of claim 9 wherein said pair of longitudinal cutters comprises a pair of heated cutting wheels, each of said wheels being rotatable about an axis arranged at an angle of about 45° with respect to the horizontal.

11. The machine of claim 10 which further includes means for pushing a bag in longitudinal direction between said wheels for rolling contact therewith.

12. The machine of claim 11 wherein said longitudinal cutter wheels are mounted on respective opposite sides of said table means and adjacent one end thereof whereby said wheels contact said bag as it is being pushed on to said table means, and which further comprises pinch roll means mounted above said longitudinal cutter wheels for engaging and pressing said bag downwardly from above as it is being pushed between said longitudinal cutter wheels.

13. The machine of claim 11 wherein said transverse cutting means comprises an elongated cutter blade mounted for pivotal movement on said table means from an inoperative position therebelow to an operative, bag engaging position projecting above said table means, means for pivoting said elongated blade between its said positions, and means for heating said elongated blade.

14. The machine of claim 9 which further comprises conveyor means for sequential feeding of full bags on to said table means and retractable stop gate means for stopping feeding movement of a bag when it is on said table means and for squaring a front end of a bag upon impact, said squaring means comprising vibrating means for settling bag contents while a bag is on said table means, means for retracting said stop gate means, second table means, means for advancing a bag from said first table means to said second table means upon retraction of said stop gate means, means for engaging at least one of the walls of a bag to hold the bag comprising a bag supporting head above said second table means, said pair of longitudinal cutters being disposed between said first and said second table means for producing longitudinal cuts in a bag while the bag is being advanced from said first table means to said second table means, and said transverse cutter being mounted adjacent to said second table means, said second table means comprising movable door means for allowing bag contents to empty under the force of gravity when said door means are opened and said bag supporting head is holding a bag, and means for removing an empty bag from said bag supporting head.

15. The machine of claim 14 wherein said bag supporting head has a plurality of spikes for engaging a bag and means for stripping a bag off said spikes, and said means for removing an empty bag comprises bag engaging roll means for pulling a bag away from said bag supporting head after the bag has been stripped off said spikes.

16. The machine of claim 15 wherein said bag engaging roll means includes a cushioned roller, and reaction plate means comprising a hingedly mounted plate and means for pivoting said plate towards and away from said cushioned roller to grip a bag.

17. The machine of claim 1 which further comprises sensing means including a movable bag stop member for indicating that a bag is centered upon said table means, means for engaging at least one of the walls of said bag to hold the bag from above when the bag is on said table means, means responsive to and coordinated with said sensing means for actuating said bag holding means to grip and hold the bag, means responsive to and coordinated with said bag holding means for actuating said cutting means to make a cut extending substantially across said bag when the bag is in its centered position on said table means, and means for elevating said bag holding means to dispose of an empty bag after said discharge of bag contents.

18. The machine of claim 17, wherein said bag stop member abuts and senses the position of a front end of a bag, and said sensing means further includes a switch mounted to sense the position of the rear end of said bag.

19. The machine of claim 1 wherein said cutting means comprises an elongated blade formed of aligned blade segments in spaced apart relation with each other sufficient to accomodate thermal expansion thereof.

20. The bag machine of claim 1 wherein said squaring means comprises vibrator means for vibrating said table means, and which further comprises means for engaging at least one of the walls of said bag to hold the bag when the bag is on said table means composing a clamping and gripping head having a vertically movable element for engaging the upwardly facing wall of a bag, a pair of parallel and spaced apart elongated movable cutters mounted adjacent to respective opposite sides of said table means whereby a bag is received on said table means therebetween, and means for moving said parallel cutters laterally toward and away from each other for contacting and pressing respective substantially vertical walls on opposite sides of said bag for cutting each of the same.

21. The machine of claim 20 which further comprises a horizontally disposed elongated cutter extending transversely with respect to and within substantially the same plane as said pair of parallel elongated cutters and adjacent to a third side of said table means, the last said cutter being mounted for lateral movement toward and away from the center of said table means for contacting and pressing a substantially vertical wall of said bag for cutting the same to form a line of cut connecting said lines of cut formed by said pair of parallel cutters.

22. The machine of claim 21 which further comprises a horizontally disposed elongated perforator bar disposed transversely with respect to said parallel elongated cutters and movably mounted adjacent to the fourth side of said table means, said perforator bar being movable toward and away from said table means to perforate a substantially vertical wall of said bag and thereby form a hinge line extending between said lines of cut formed by said pair of parallel cutters.

23. The machine of claim 22 wherein said movable element of said clamping and gripping head mounts a horizontally stationary plate and a vertically movable horizontal clamping plate below said stationary plate, said stationary plate having a plurality of downwardly projecting spikes attached thereto and said movable clamping plate having means defining respective apertures thereof for passage of said spikes therethrough, the thickness of said clamping plate being less than the lengths of said spikes, and means for moving said clamping plate toward and away from said stationary plate between respective positions thereof respectively concealing and exposing said spikes therethrough.

24. The machine according to claim 23 wherein said clamping and gripping head is further movable between a vertical position thereof wherein a bag on said table means will be contacted by said clamping plate thereof and a laterally oriented position thereof wherein said stationary and clamping plates face substantially towards a side of said machine.

25. The machine of claim 24 which further comprises an empty bag discharge chute mounted on said side of the machine, said stationary and clamping plates of said head being disposed substantially above said discharge chute when said head is in its said second position.

26. The machine of claim 1, wherein said cutting has means for heating the same to a temperature between 800° F. and 1000° F.

* * * * *